US009957851B2

(12) United States Patent
Takahata et al.

(10) Patent No.: US 9,957,851 B2
(45) Date of Patent: May 1, 2018

(54) DEVICE FOR CONTROLLING VALVE TIMING OF ENGINE

(71) Applicant: MAZDA MOTOR CORPORATION, Hiroshima (JP)

(72) Inventors: Tatsuya Takahata, Hiroshima (JP); Keiichi Miyamoto, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days. days.

(21) Appl. No.: 15/112,053

(22) PCT Filed: Feb. 23, 2015

(86) PCT No.: PCT/JP2015/000871
§ 371 (c)(1),
(2) Date: Jul. 15, 2016

(87) PCT Pub. No.: WO2015/129241
PCT Pub. Date: Sep. 3, 2015

(65) Prior Publication Data

US 2016/0341079 A1 Nov. 24, 2016

(30) Foreign Application Priority Data

Feb. 28, 2014 (JP) ..... 2014-038560

(51) Int. Cl.
*F01L 1/34* (2006.01)
*F01L 1/344* (2006.01)
(Continued)

(52) U.S. Cl.
CPC ..... *F01L 1/3442* (2013.01); *F01M 1/16* (2013.01); *F01L 1/185* (2013.01); *F01L 1/2405* (2013.01);
(Continued)

(58) Field of Classification Search
CPC ..... F01L 1/3442; F01L 1/185; F01L 1/2405; F01L 2001/34456; F01L 2001/34483;
(Continued)

(56) References Cited

U.S. PATENT DOCUMENTS

2003/0200944 A1 10/2003 Takahashi et al.
2013/0180480 A1* 7/2013 Rollinger ..... F01L 1/3442 123/90.15

FOREIGN PATENT DOCUMENTS

JP H07-091280 A 4/1995
JP 2003-314311 A 11/2003
(Continued)

OTHER PUBLICATIONS

International Search Report and Written Opinion issued in PCT/JP2015/000871; dated May 26, 2015.

*Primary Examiner* — Zelalem Eshete
(74) *Attorney, Agent, or Firm* — Studebaker & Brackett PC

(57) ABSTRACT

Provided are a variable valve timing mechanism, an oil pump supplying oil to a hydraulically-actuated device including the variable valve timing mechanism, and a hydraulic control valve which controls oil pressures supplied to a locking mechanism (which includes a locking member configured to fix a phase angle of a camshaft relative to a crankshaft) of the variable valve timing mechanism, an advanced angle chamber and a retarded angle chamber. While an oil pressure in a hydraulic path detected by a hydraulic sensor increases, a hydraulic control valve controller adjusts a degree of opening of a hydraulic control valve according to the detected oil pressure at a time of releasing the locking member from a locking state, to reduce the oil pressure to be supplied to the advanced angle
(Continued)

chamber or the retarded angle chamber used to change the phase angle of the camshaft relative to the crankshaft.

4 Claims, 17 Drawing Sheets

(51) Int. Cl.

| | |
|---|---|
| ***F01M 1/16*** | (2006.01) |
| *F01L 1/18* | (2006.01) |
| *F01L 1/24* | (2006.01) |
| *F01L 1/053* | (2006.01) |
| *F01M 1/02* | (2006.01) |

(52) U.S. Cl.
CPC ..... *F01L 2001/0537* (2013.01); *F01L 2001/3443* (2013.01); *F01L 2001/34456* (2013.01); *F01L 2001/34473* (2013.01); *F01L 2001/34483* (2013.01); *F01L 2250/02* (2013.01); *F01L 2810/02* (2013.01); *F01M 2001/0238* (2013.01); *F01M 2001/0246* (2013.01); *F01M 2250/00* (2013.01)

(58) Field of Classification Search
CPC ..... F01L 2001/0537; F01L 2001/3447; F01L 2001/34473; F01L 2001/3443; F01L 2810/02; F01M 1/16; F01M 2250/00; F01M 2250/02; F01M 2001/0238; F01M 2001/0246
USPC ..... 123/90.17, 90.15
See application file for complete search history.

(56) References Cited

FOREIGN PATENT DOCUMENTS

| | | | |
|---|---|---|---|
| JP | 2012-225171 | A | 11/2012 |
| JP | 2013-104376 | A | 5/2013 |

* cited by examiner

FIG.11A LOW LOAD
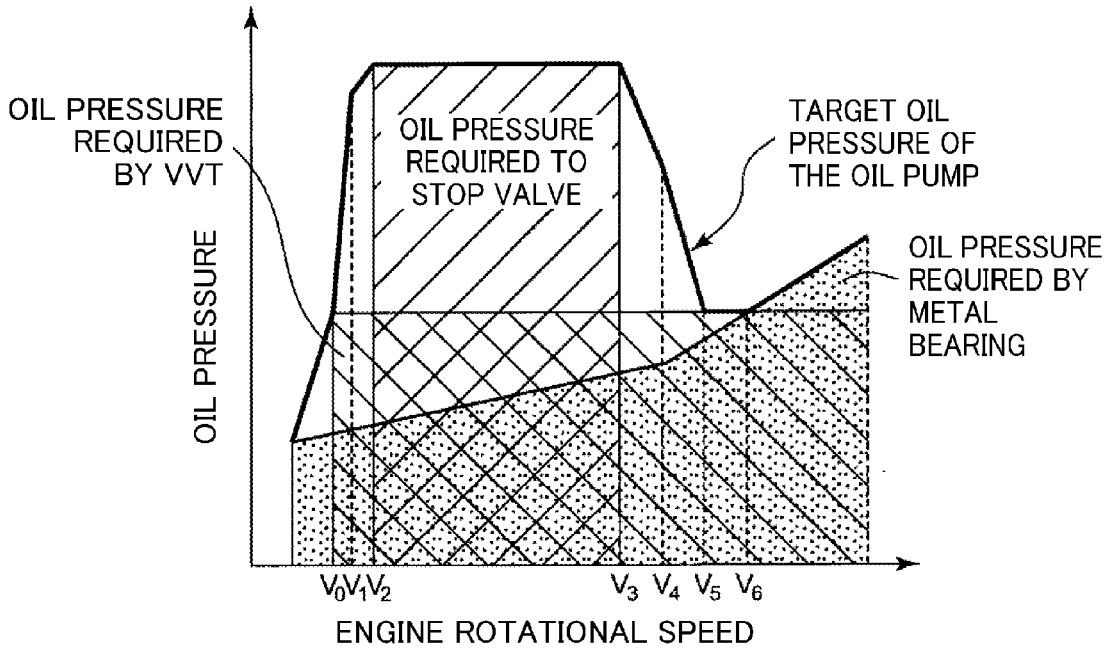
FIG.11B HIGH LOAD
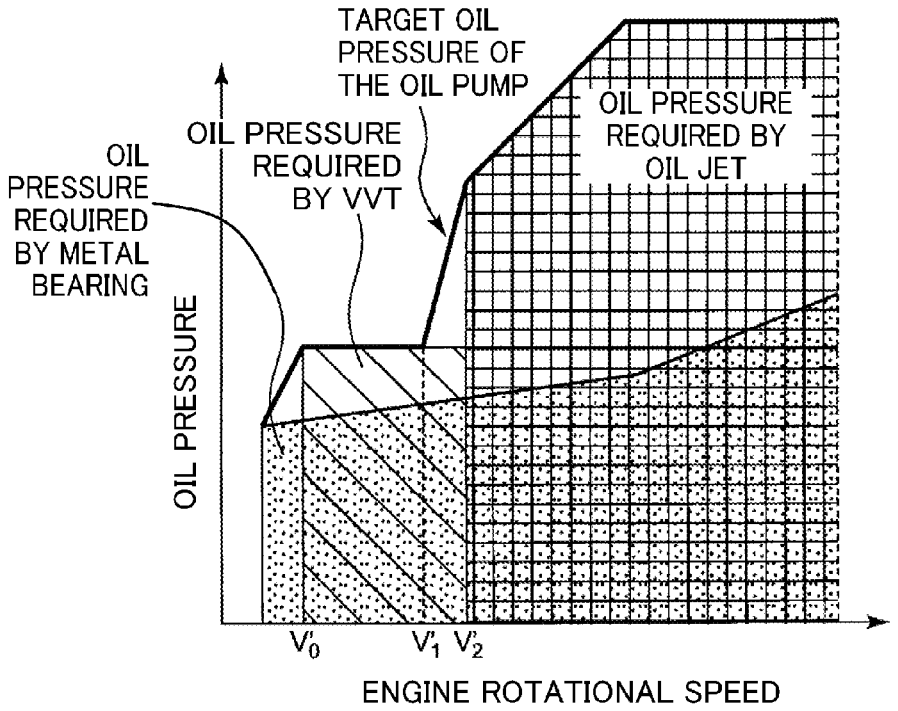

FIG.12A HIGH TEMPERATURE
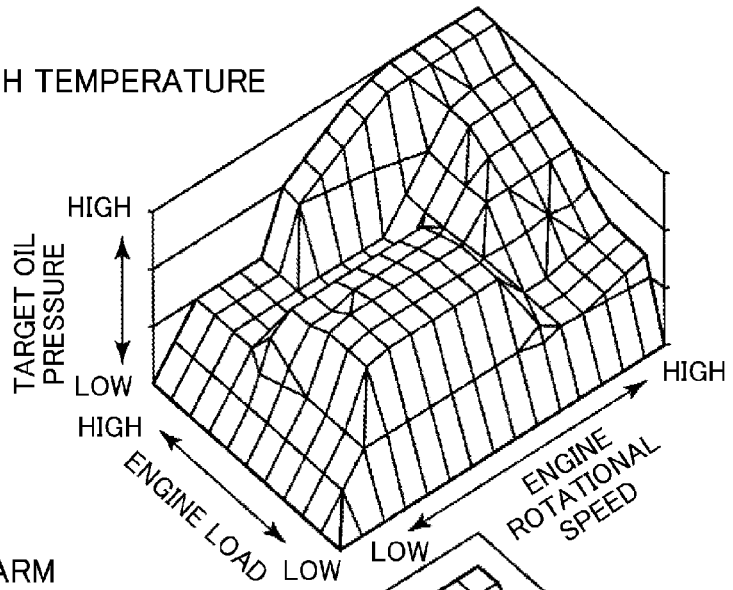
FIG.12B WARM
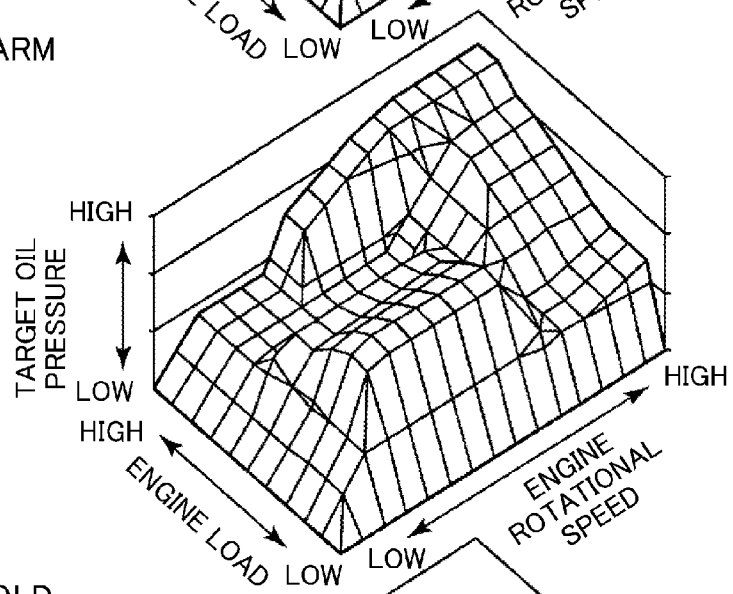
FIG.12C COLD
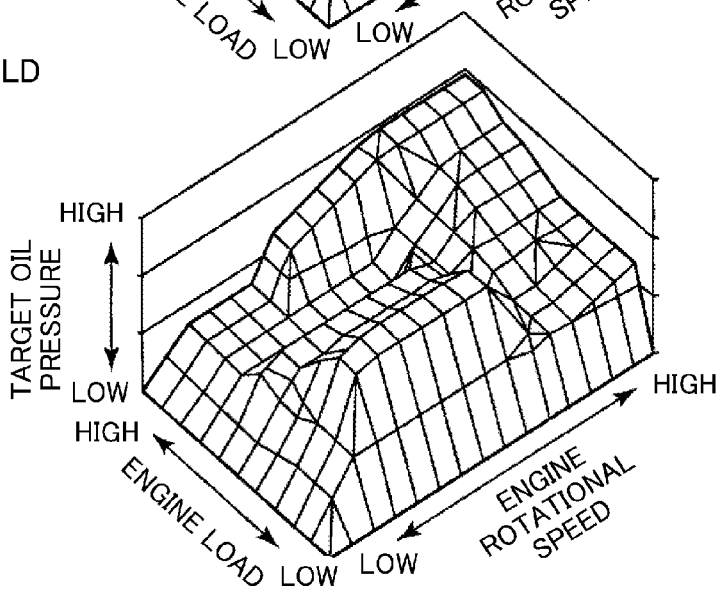

FIG.13A HIGH TEMPERATURE
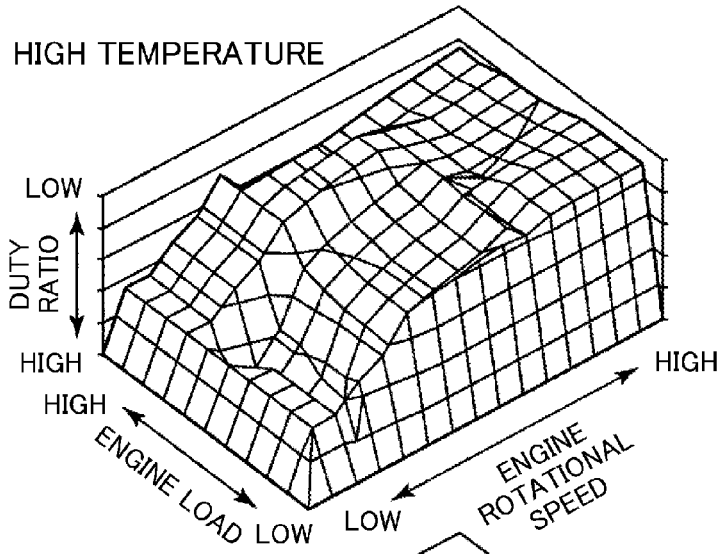
FIG.13B WARM
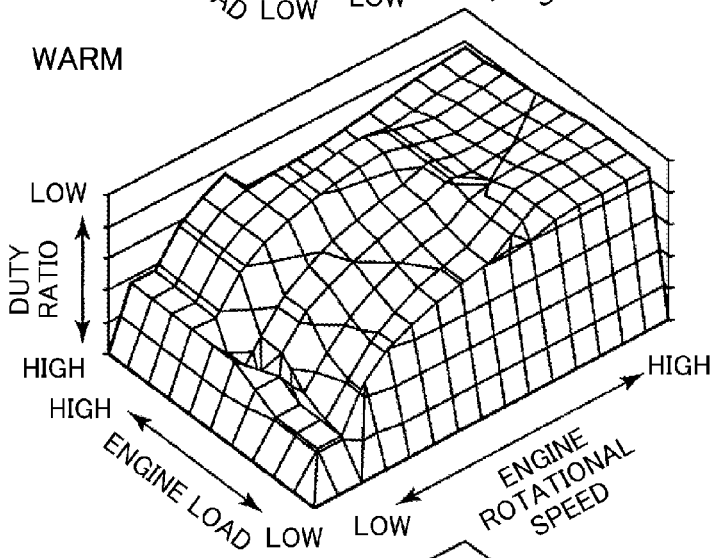
FIG.13C COLD
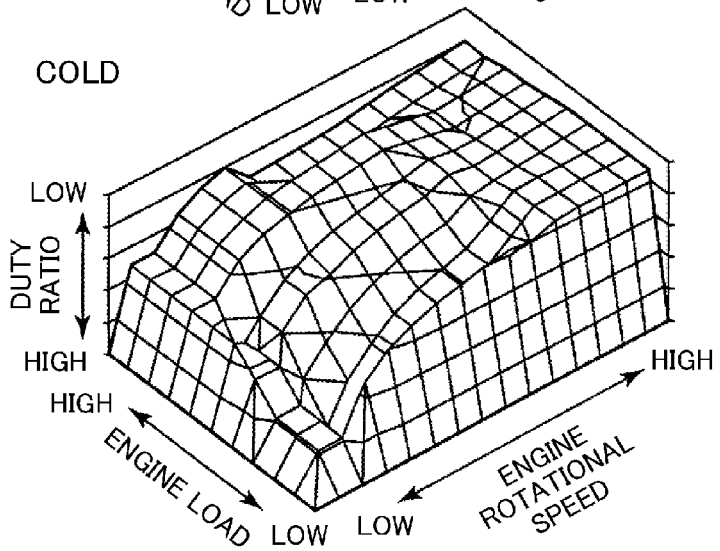

DEVICE FOR CONTROLLING VALVE TIMING OF ENGINE

TECHNICAL FIELD

The present invention belongs to a technical field relating to a valve timing control device for an engine which controls opening/closing timing of intake and exhaust valves of the engine according to an operational state of the engine, using a hydraulically-actuated variable valve timing mechanism.

BACKGROUND ART

Hydraulically-actuated variable valve timing mechanisms have been well known. Such mechanisms include an advanced angle chamber and a retarded angle chamber defined by a housing, which rotates in conjunction with the rotation of the crankshaft of the engine, and a vane body, which rotates integrally with a camshaft. Oil pressure is applied to the advanced angle chamber and the retarded angle chamber to change a phase angle of the camshaft relative to the crankshaft, thereby changing the opening/closing timing of the valve.

Patent Document 1 discloses a hydraulically-actuated variable valve timing mechanism, which is provided with a locking mechanism that locks the operation of the variable valve timing mechanism. The locking mechanism has a stopper pin that fixes the vane body at a predetermined rotation angle relative to the housing (i.e., a locking pin that fixes the phase angle of the camshaft relative to the crankshaft). In releasing the stopper pin from a locking state by using oil pressure and transiting to a phase control, oil pressures before and after it is controlled by a hydraulic control valve, which adjusts the oil pressure to be applied to the advanced angle chamber and the retarded angle chamber, are calculated to avoid unsuccessful release of the stopper pin from the locking state due to variations in the pressure applied to the advanced angle chamber and the retarded angle chamber during release of the stopper pin from the locking state, by adjusting the timing of transition to the phase control according to the obtained oil pressures before and after the valve control.

CITATION LIST

Patent Document

Patent Document 1: Japanese Unexamined Patent Publication No. 2013-104376

SUMMARY OF THE INVENTION

Technical Problem

Specifically, according to Patent Document 1, the oil pressures before and after the control of the hydraulic control valve are calculated, and the timing of transition to the phase control is retarded according to the obtained oil pressures before and after the valve control, to ensure time for releasing the stopper pin from the locking state. To achieve this, the timing of transition to the phase control needs to be retarded sufficiently so that the stopper pin can be released from the locking state for sure. This makes it difficult to determine a valve-opening phase suitable for the ever-changing operational state of the engine while engine rotational speeds or engine loads increase (while the engine is accelerated).

In view of the foregoing, it is therefore an object of the present invention to ensure successful release of a locking member of a locking mechanism in a variable valve timing mechanism from a locking state, and achieving prompt transition to phase control during engine acceleration.

Solution to the Problem

To achieve the above objective, the present invention provides a valve timing control device for an engine which includes: a hydraulically-actuated variable valve timing mechanism provided with an advanced angle chamber and a retarded angle chamber defined by a housing, which rotates in conjunction with a crankshaft of the engine, and a vane body, which rotates integrally with a camshaft, each of the advanced angle chamber and the retarded angle chamber being used to change a phase angle of the camshaft relative to the crankshaft by being supplied with an oil pressure, and a locking mechanism which includes a locking member configured to fix the phase angle of the camshaft relative to the crankshaft, and releases the locking member from a locking state through supply of an oil pressure; an oil pump which supplies oil to a hydraulically-actuated device of the engine via a hydraulic path, the hydraulically-actuated device including the variable valve timing mechanism; a hydraulic control valve which controls the oil pressures supplied to the locking mechanism, the advanced angle chamber and the retarded angle chamber; a hydraulic sensor which detects an oil pressure in the hydraulic path; and a hydraulic control valve controller which control operation of the hydraulic control valve, wherein while the oil pressure detected by the hydraulic sensor increases, the hydraulic control valve controller adjusts a degree of opening of the hydraulic control valve according to the detected oil pressure at a time of releasing the locking member of the locking mechanism from the locking state, to reduce the oil pressure to be supplied to the advanced angle chamber or the retarded angle chamber used to change the phase angle of the camshaft relative to the crankshaft.

In the above configuration, while the oil pressure detected by the hydraulic sensor increases due to the engine acceleration, a degree of opening of the hydraulic control valve is adjusted according to the detected oil pressure at a time of releasing the locking member from the locking state, to reduce the oil pressure to be supplied to the advanced angle chamber or the retarded angle chamber used to change the phase angle of the camshaft relative to the crankshaft. Thus, even if the oil pressure detected increases due to the engine acceleration, the oil pressure to be supplied to the advanced angle chamber or the retarded angle chamber is maintained at a low oil pressure by the hydraulic control valve during release of the locking state. Even in such a low oil pressure, the camshaft (the vane body) tends to phase-shift (or turn) relative to the crankshaft (the housing) in an advanced angle direction or a retarded angle direction if there is a difference between the oil pressure supplied to the advanced angle chamber and the oil pressure supplied to the retarded angle chamber. However, the locking member in the locking state prevents such a phase shift. Even if the camshaft (the vane body) tends to phase-shift relative to the crankshaft (the housing), it is possible to carry out stable release of the locking pin from the locking state since the oil pressure supplied to the advanced angle chamber or the retarded angle chamber is low. Once the locking state is released, the camshaft (the vane body) promptly phase-shifts relative to the crankshaft (the housing) and thereby shifts from the locked position. This allows prompt control of the phase.

The phase may be more promptly controlled by increasing the oil pressure to be supplied to the advanced angle chamber or the retarded angle chamber by adjusting the hydraulic control valve when such a phase shift is detected. As a result, the locking member may be reliably released from the locking state, and the phase may be promptly controlled, while the engine is accelerated.

It is recommended that the above valve timing control device for an engine further includes an oil temperature sensor which detects an oil temperature in the hydraulic path, and that the hydraulic control valve controller is configured to correct an adjustment value of the degree of opening of the hydraulic control valve according to the oil temperature detected by the oil temperature sensor.

Thus, the oil pressure supplied to the advanced angle chamber or the retarded angle chamber during the release of the locking state may be maintained at more appropriate oil pressure capable of carrying out stable release of the locking member from the locking state, by taking the oil viscosity into account.

In an embodiment of the above valve timing control device for an engine, the oil pump is a variable oil pump whose oil discharge amount is controllable, and the valve timing control device for the engine further comprises a pump controller which controls the oil discharge amount of the oil pump such that the oil pressure detected by the hydraulic sensor be a target oil pressure determined according to an operational state of the engine.

In particular, a variable displacement oil pump is well responsive in adjusting a target oil pressure to a higher setting during acceleration of the engine, and hence the oil pressure detected by a hydraulic sensor abruptly increases. Even in such a situation, the present invention allows stable and reliable release of the locking member from the locking state, and allows for immediate phase control after the release from the locking state. In addition, the present invention allows the oil pump to discharge an appropriate amount of oil according to the operational state of the engine, which leads to a reduction in the engine load for driving the oil pump, and improvement in the fuel efficiency.

Advantages of the Invention

As can be seen from the forgoing description, a valve timing control device for an engine of the present invention is configured such that while an oil pressure detected by a hydraulic sensor increases, a degree of opening of a hydraulic control valve is adjusted according to the detected oil pressure at a time of releasing a locking member of a locking mechanism, to reduce an oil pressure supplied to an advanced angle chamber or a retarded angle chamber used to change a phase angle of a camshaft relative to a crankshaft. As a result, the locking member may be reliably released from the locking state, and the phase may be promptly controlled, while the engine is accelerated.

BRIEF DESCRIPTION OF THE DRAWINGS

FIG. 11A is a diagram for explaining settings of target oil pressures of the pump while the engine is in low load operation. FIG. 11B is a diagram for explaining settings of target oil pressures of the pump while the engine is in high load operation.

FIG. 12A is a hydraulic control map showing target oil pressures corresponding to the respective operational states of the engine while the temperature of the engine is high. FIG. 12B is a hydraulic control map showing target oil pressures corresponding to the respective operational states of the engine while the engine is warm. FIG. 12C is a hydraulic control map showing target oil pressures corresponding to the respective operational states of the engine while the engine is cold.

FIG. 13A is a duty ratio map showing duty ratios corresponding to the respective operational states of the engine while the temperature of the engine is high. FIG. 13B is a duty ratio map showing duty ratios corresponding to the respective operational states of the engine while the engine is a warm. FIG. 13C is a duty ratio map showing duty ratios corresponding to the respective operational states of the engine while the engine is cold.

DESCRIPTION OF EMBODIMENTS

An embodiment of the present invention will be described in detail below based on the drawings.

Figure 1:
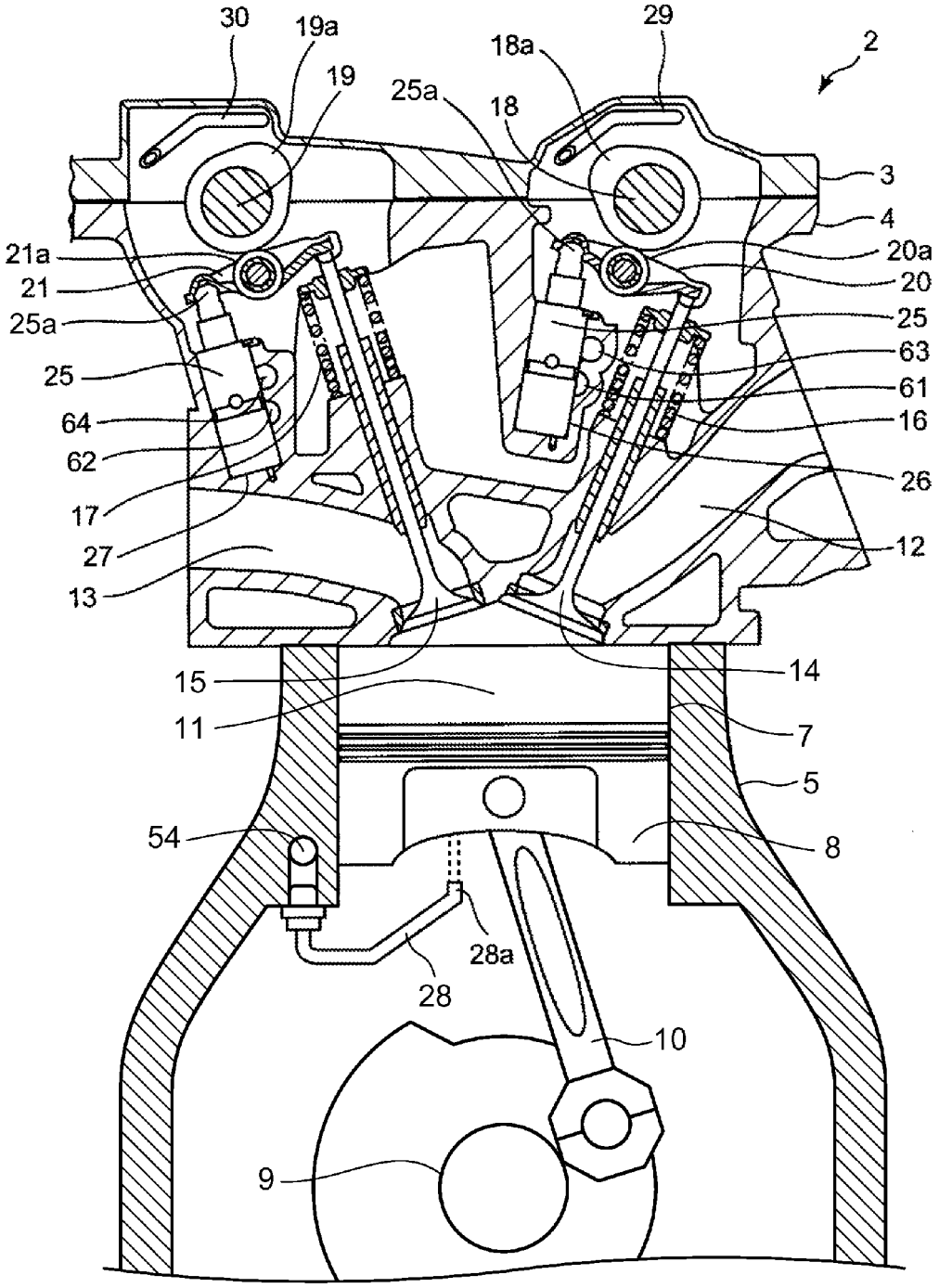
FIG. 1 generally illustrates a cross-section of an engine provided with a hydraulically-actuated variable valve timing mechanism included in a valve timing control device according to an embodiment of the present invention.

FIG. 1 illustrates an engine 2 provided with a hydraulically-actuated variable valve timing mechanism included in a valve timing control device of an embodiment of the present invention. The engine 2 is an inline-four gasoline engine in which first to fourth cylinders are sequentially arranged in a straight line orthogonal to the sheet of FIG. 1, and is mounted on a vehicle, such as an automobile. The engine 2 includes a cam cap 3, a cylinder head 4, a cylinder block 5, a crankcase (not shown) and an oil pan 6 (see FIG. 8), which are coupled to one another in a vertical direction. A piston 8 which slides in an associated one of four cylinder bores 7 formed in the cylinder block 5 and a crankshaft 9 rotatably supported on the crankcase are coupled to each other with a connecting rod 10. The cylinder bore 7 in the cylinder block 5, the piston 8 and the cylinder head 4 form a combustion chamber 11 for each cylinder.

The cylinder head 4 is provided with an intake port 12 and an exhaust port 13 which are open to the combustion chamber 11. An intake valve 14 and an exhaust valve 15 which opens/closes the intake port 12 and the exhaust port 13, respectively, are provided at the ports 12, 13. The intake valve 14 and the exhaust valve 15 are biased in a closing direction (i.e., upward in FIG. 1) by return springs 16, 17, respectively. A cam portion 18*a*, 19*a* provided to the outer circumference of the rotating camshaft 18, 19 pushes down a cam follower 20*a*, 21*a* provided at an approximately middle position of a swing arm 20, 21. At this moment, the swing arm 20, 21 swings so as to pivot on the top of a pivot mechanism 25*a* provided at one end of the swing arm 20, 21, using the top of the pivot mechanism 25*a* as a fulcrum point. As a result, the other end of the swing arm 20, 21 pushes down the intake valve 14 and the exhaust valve 15 to the valve-opening position against the biasing force of the return spring 16, 17.

A known hydraulic lash adjuster 24 (hereinafter abbreviated as "HLA 24") which automatically adjusts a valve clearance to zero using oil pressure is provided as a pivot mechanism (a same or similar structure as that of a pivot mechanism 25*a* of an HLA 25 which will be described below) for the swing arm 20, 21 of each of the second and third cylinders located in the middle of the engine 2 in the cylinder arrangement direction. The HLA 24 is illustrated in only FIG. 8.

The swing arm 20, 21 of each of the first and fourth cylinders located at the ends of the engine 2 in the cylinder arrangement direction is provided with an HLA 25 with valve stop system that includes the pivot mechanism 25*a*. The HLA 25 with valve stop system is configured to automatically adjust a valve clearance to zero, just like the HLA 24, and is also configured to stop the operation (i.e., stop the opening/closing movements) of the intake and exhaust valves 14, 15 of the first and fourth cylinders during a reduced cylinder operation in which the first and fourth cylinders, which are part of all the cylinders of the engine 2, are deactivated, and operate (i.e., open/close) the intake and exhaust valves 14, 15 of the first and fourth cylinders during a full cylinder operation in which all the cylinders (i.e., four cylinders) are activated. The intake and exhaust valves 14, 15 of the second and third cylinders are operated in both of the reduced cylinder operation and the full cylinder operation. That is, of all the cylinders of the engine 2, operations of the intake and exhaust valves 14, 15 of only the first and fourth cylinders are stopped in the reduced cylinder operation, and the intake and exhaust valves 14, 15 of all the cylinders are operated in the full cylinder operation. Note that the reduced cylinder operation and the full cylinder operation are switched according to the operational state of the engine 2, as will be described later.

The cylinder head 4 is provided, at portions corresponding to the intake side and the exhaust side of the first and fourth cylinders, with attachment holes 26, 27, respectively, each for inserting and attaching a lower end portion of the HLA 25 with valve stop system to the cylinder head 4. The cylinder head 4 is also provided, at portions corresponding to the intake side and exhaust side of the second and third cylinders, with attachment holes similar to the attachment holes 26, 27, respectively, each for inserting and attaching a lower end portion of the HLA 24. The cylinder head 4 is further provided with two oil passages 61, 63 (62, 64) which communicate with the attachment hole 26 (27) for attaching the HLA 25 with valve stop system. In a state in which the HLA 25 with valve stop system is fitted in the attachment hole 26, 27, the oil passages 61, 62 supply oil pressure (operating pressure) which actuates the valve stop system (not shown) of the HLA 25 with valve stop system, whereas the oil passages 63, 64 supply oil pressure which is used when the pivot mechanism 25*a* of the HLA 25 with valve stop system automatically adjusts a valve clearance to zero. Note that only the oil passages 63, 64 communicate with the attachment hole for the HLA 24. The oil passages 61-64 will be described in detail later based on FIG. 8.

The cylinder block 5 is provided with a main gallery 54 which extends in the cylinder arrangement direction in a side wall of the cylinder block 5 on the exhaust side of the cylinder bores 7. An oil jet 28 (an oil injection valve) which communicates with the main gallery 54 for injecting oil to cool the piston is provided close to under the main gallery 54 so as to correspond to each piston 8. The oil jet 28 has a nozzle 28*a* located under the piston 8. Engine oil (hereinafter simply referred to as "oil") is injected from this nozzle 28*a* to the back side of the top of the piston 8.

Oil showers 29, 30 made of pipe are provided above the camshafts 18, 19, respectively. The oil for lubrication is dropped from the oil shower 29, 30 to the cam portion 18*a*, 19*a* of the camshaft 18, 19 located below the oil shower 29, 30 and the contact portion between the swing arm 20, 21 and the cam follower 20*a*, 21*a* which are further below the oil shower 29.

Now, the valve stop system, which is an example of the hydraulically-actuated device, will be described. The valve stop system is configured to stop the operation of at least one of the intake and exhaust valves 14, 15 (both valves in the present embodiment) of the first and fourth cylinders which are part of all the cylinders of the engine 2, using the oil pressure according to the operational state of the engine 2. Specifically, the valve stop system stops the opening/closing movements of the intake and exhaust valves 14, 15 of the first and fourth cylinders when the operation mode is switched to the reduced cylinder operation according to the operational state of the engine 2. The valve stop system no longer stops the valve movement, and the intake and exhaust valves 14, 15 of the first and fourth cylinders are opened and closed, when the operation mode is switched to the full cylinder operation.

The valve stop system is provided at the HLA 25 with valve stop system. Thus, the HLA 25 with valve stop system has the pivot mechanism 25*a* and the valve stop system. The pivot mechanism 25*a* has substantially the same structure as a known pivot mechanism of the HLA 24 which automatically adjusts a valve clearance to zero using oil pressure.

Although not shown, the valve stop system has a pair of locking pins capable of going in and out of respective through holes formed at two locations opposed to each other in a side surface of a closed-end outer cylinder which houses the pivot mechanism 25*a* in a slidable manner in the axial direction. The pair of locking pins are biased radially outward by a spring. A lost motion spring is provided in a space between an inner bottom of the outer cylinder and the bottom of the pivot mechanism 25*a*. The pivot mechanism 25*a* is pushed, and hence biased, to the upper side of the outer cylinder by the lost motion spring.

The pivot mechanism 25*a* is fixed, with its portion above the locking pins protruding above the outer cylinder, in a state in which both of the locking pins are fitted in the through holes of the outer cylinder. In this state, the top of the pivot mechanism 25*a* serves as a fulcrum point of the swing of the swing arm 20, 21. Thus, when the camshaft 18, 19 rotates and the cam portion 18*a*, 19*a* pushes down the cam follower 20*a*, 21*a*, the intake and exhaust valves 14, 15 are pushed down against the biasing force of the return spring 16, 17 to the valve-opening position. Thus, the full cylinder operation is achieved by bringing the valve stop systems of the first and fourth cylinders into a state in which the locking pins are fitted in the through holes.

On the other hand, when outer end surfaces of both of the locking pins are pushed by the operating oil pressure, the locking pins move backward, that is, toward the inner side of the outer cylinder in the radial direction, such that both of the locking pins come closer to each other against the compressing force of the spring. This makes the locking pins come out of the fitted state with the through holes. As a result, the pivot mechanism 25*a* above the locking pins, and the locking pins as well, move down to a lower portion of the outer cylinder in the axial direction. The operation of the valve is thus stopped. In this structure, the biasing force of the return spring 16, 17 which biases the intake/exhaust valve 14, 15 upward is greater than the biasing force of the lost motion spring which biases the pivot mechanism 25*a* upward. Thus, when the camshaft 18, 19 rotates and the cam portion 18*a*, 19*a* pushes down the cam follower 20*a*, 21*a*, the top of the intake/exhaust valve 14, 15 serves as a fulcrum point of the swing of the swing arm 20, 21, and the pivot mechanism 25*a* is pushed down against the biasing force of the lost motion spring, with the intake/exhaust valve 14, 15 closed. Thus, the reduced cylinder operation is achieved by letting the locking pins come out of the fitted state with the through holes, using the operating oil pressure.

Figure 2:
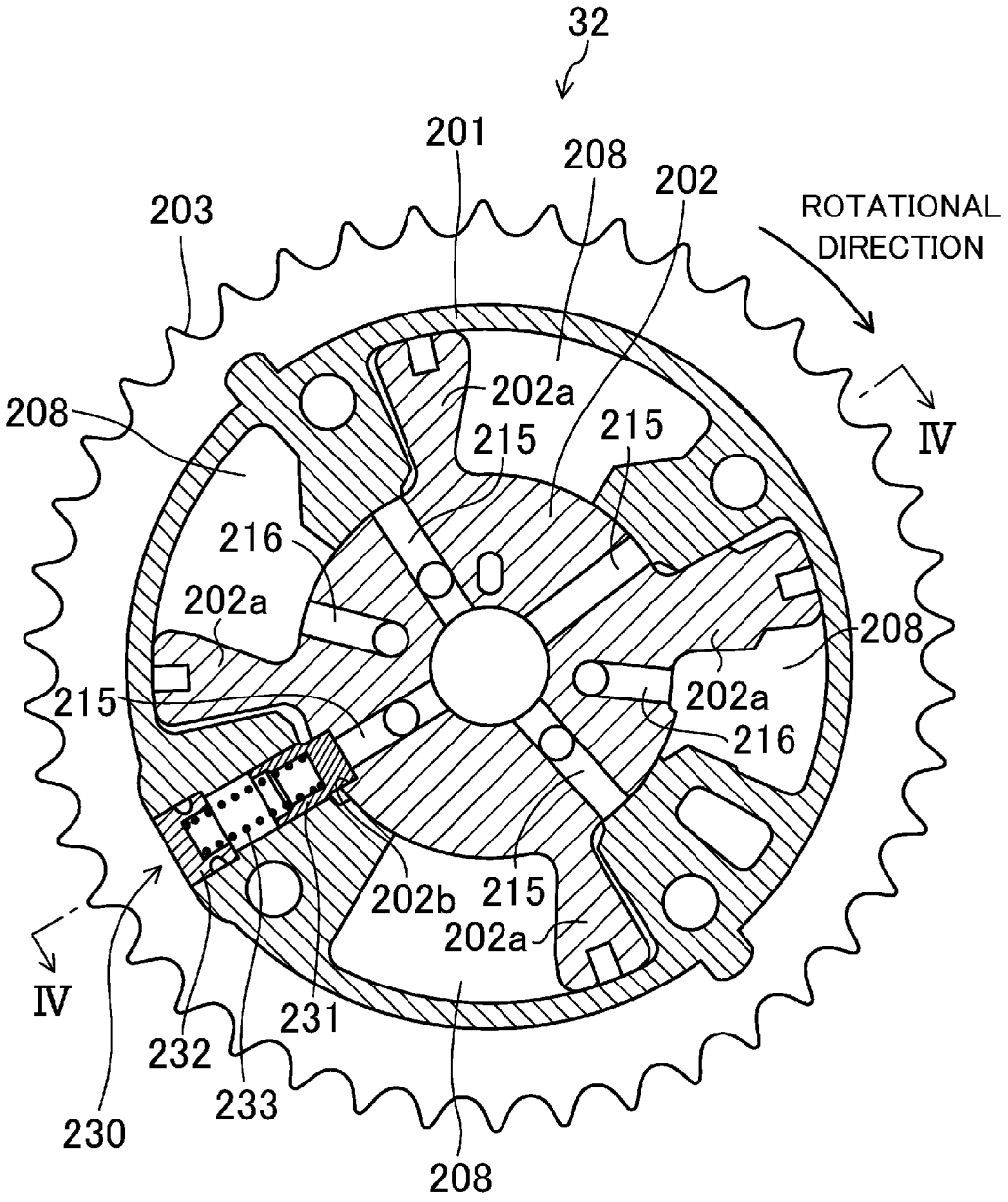
FIG. 2 is a cross-section of an intake-side variable valve timing mechanism, taken along a plane perpendicular to a camshaft, for showing a vane body (the camshaft) locked by a locking pin of a locking mechanism.
Figure 3:
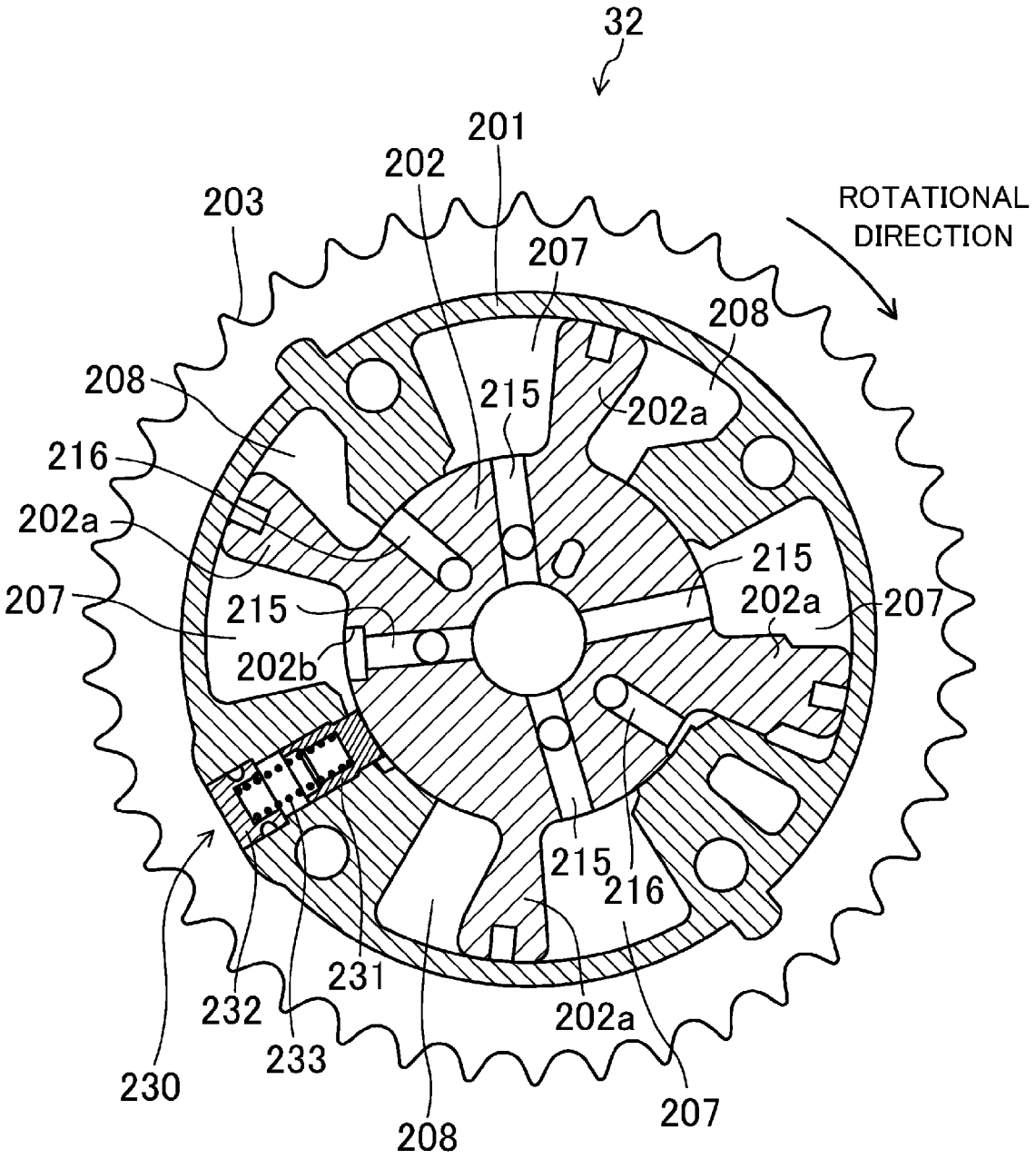
FIG. 3 corresponds to FIG. 2, and illustrates a state in which the locking pin of the locking mechanism is released from the locking state and in which the vane body turns in an advanced angle direction with respect to housing.
Figure 4:
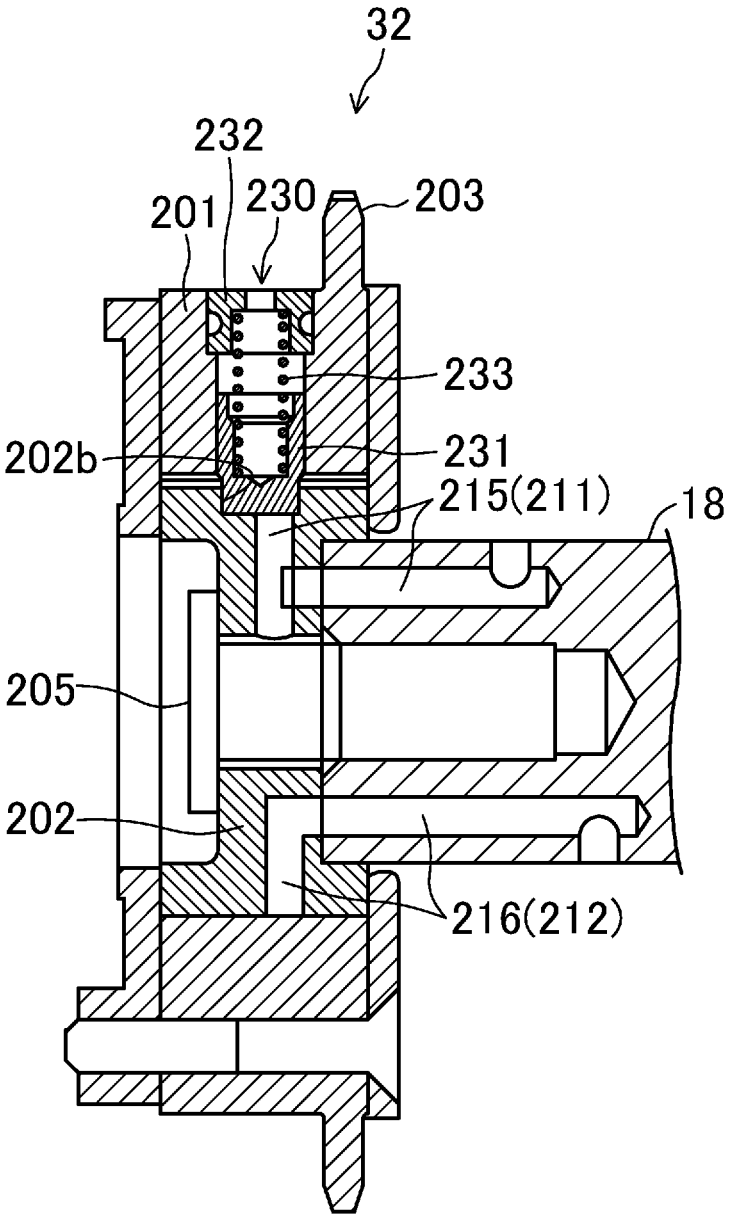
FIG. 4 is a cross-section taken along the IV-IV plane in FIG. 2.

Now, an intake-side variable valve timing mechanism 32 (hereinafter referred to as a "VVT 32"), which is an example of the hydraulically-actuated device, will be described with reference to FIGS. 2-4.

The VVT 32 includes an approximately annular housing 201 and a vane body 202 housed in the interior of the housing 201. The housing 201 is coupled with a cam pulley 203 in such a manner that allows the housing 201 to rotate integrally with the cam pulley 203. Since the cam pulley 203 rotates in synchronization with the rotation of the crankshaft 9, the housing 201 rotates in conjunction with the crankshaft 9. The vane body 202 is coupled with the camshaft 18, which opens/closes the intake valve 14, with a bolt 205 (see FIG. 4) in such a manner that allows the vane body 202 to rotate integrally with the camshaft 18.

The interior of the housing 201 is provided with a plurality of advanced angle chambers 207 and a plurality of retarded angle chambers 208 which are defined by the inner peripheral surface of the housing 201 and vanes 202*a* provided on the outer peripheral surface of the vane body 202. Each of the advanced angle chambers 207 and the retarded angle chambers 208 is connected to an intake-side first direction switching valve 34, which is a hydraulic control valve, via an advanced angle side oil passage 211 and a retarded angle side oil passage 212, respectively (see FIG. 8). The camshaft 18 and the vane body 202 are provided with an advanced angle side passage 215 and a retarded angle side passage 216 which respectively form part of the advanced angle side oil passage 211 and the retarded angle side oil passage 212.

The advanced angle side passage 215 is formed in the vane body 202 so as to extend radially from near the center of the vane body 202, and is connected to each advanced angle chamber 207. The retarded angle side passage 216 is formed in the vane body 202 so as to extend radially from near the center of the vane body 202, and is connected to each retarded angle chamber 208. One of the plurality of advanced angle side passages 215 each extending radially from near the center of the vane body 202 is connected to the bottom of a fitting recess 202*b* which is formed in the outer peripheral surface of the vane body 202 at a position where no vane 202*a* is provided, and to which a locking pin 231 (a locking member), described later, is fitted. The one of the plurality of advanced angle side passages 215 communicates with one of the plurality of advanced angle chambers 207 through the fitting recess 202*b*.

The VVT 32 is provided with a locking mechanism 230 which locks the movement of the VVT 32. The locking mechanism 230 has a locking pin 231 for fixing a phase angle of the camshaft 18 relative to the crankshaft 9 to a particular phase angle. In the present embodiment, the particular phase angle is a most retarded phase angle. However, the particular phase angle is not limited thereto, and may be any phase angle.

The locking pin 231 is slidable in the radial direction of the housing 201. A spring holder 232 is fixed to the housing 201 at a portion radially outside the housing 201 so as to correspond to the locking pin 231. A locking pin biasing spring 233, which biases the locking pin 231 radially inward of the housing 201, is provided in a space between the spring holder 232 and the locking pin 231. When the fitting recess 202*b* comes to a position opposed to the locking pin 231, the locking pin 231 is fitted in the fitting recess 202*b* and is brought into a locking state due to the locking pin biasing spring 233. The vane body 202 is fixed to the housing 201 in this manner, thereby fixing the phase angle of the camshaft 18 relative to the crankshaft 9.

The advanced angle chambers 207 and the retarded angle chambers 208 are connected to the intake-side first direction switching valve 34 via the advanced angle side oil passage 211 and the retarded angle side oil passage 212, respectively. The intake-side first direction switching valve 34 is connected to a variable displacement oil pump 36, described later, which is a variable oil pump for supplying oil (see FIG. 8). Control of the intake-side first direction switching valve 34 enables control of amounts of oil supply to the advanced angle chambers 207 and the retarded angle chambers 208. If the intake-side first direction switching valve 34 is controlled to supply a larger amount of oil (higher oil pressure) to the retarded angle chambers 208 than to the advanced angle chambers 207, the camshaft 18 (the vane body 202) turns opposite the rotational direction thereof (the direction indicated by the arrows in FIGS. 2 and 3) relative to the housing 201 (the crankshaft 9). Thus, the opening timing of the intake valve 14 is retarded, and the locking pin 231 is fitted in the fitting recess 202*b* when the camshaft 18 is positioned at its most retarded angle (see FIG. 2). On the other hand, if the intake-side first direction switching valve 34 is controlled to supply a larger amount of oil (higher oil pressure) to the advanced angle chambers 207 than to the retarded angle chambers 208, the camshaft 18 turns in the rotational direction, and the opening timing of the intake valve 14 is advanced (see FIG. 3). To advance the camshaft 18 from its most retarded angle position, the locking pin 231 is pushed radially outward of the housing 201 against the locking pin biasing spring 233, using oil pressure, thereby releasing the locking pin 231 from the locking state. At this moment, the advanced angle chambers 207 other than the advanced angle chamber 207 communicating with the fitting recess 202*b* have already been filled with oil. Thus, the opening timing of the intake valve 14 can be advanced by controlling the intake-side first direction switching valve 34 and turning the camshaft 18 in the rotational direction soon after the release of the locking pin 231 from the locking state. Note that to release the locking pin 231 from the locking state, oil pressure greater than the biasing force of the locking pin biasing spring 233 needs to be supplied to the advanced angle chambers 207. This oil pressure can be obtained by controlling the intake-side first direction switching valve 34, and also by controlling an oil discharge amount of the variable displacement oil pump 36. Supplying this oil pressure to the advanced angle chambers 207 and supplying an oil pressure (basically, oil pressure close to 0) lower than this oil pressure to the retarded angle chambers 208 make the camshaft 18 turn in the rotational direction and move away from the locking position soon after the release of the locking pin 231 from the locking state. The intake-side first direction switching valve 34 is then controlled to control the valve-opening phase of the intake valve 14.

Figure 5:
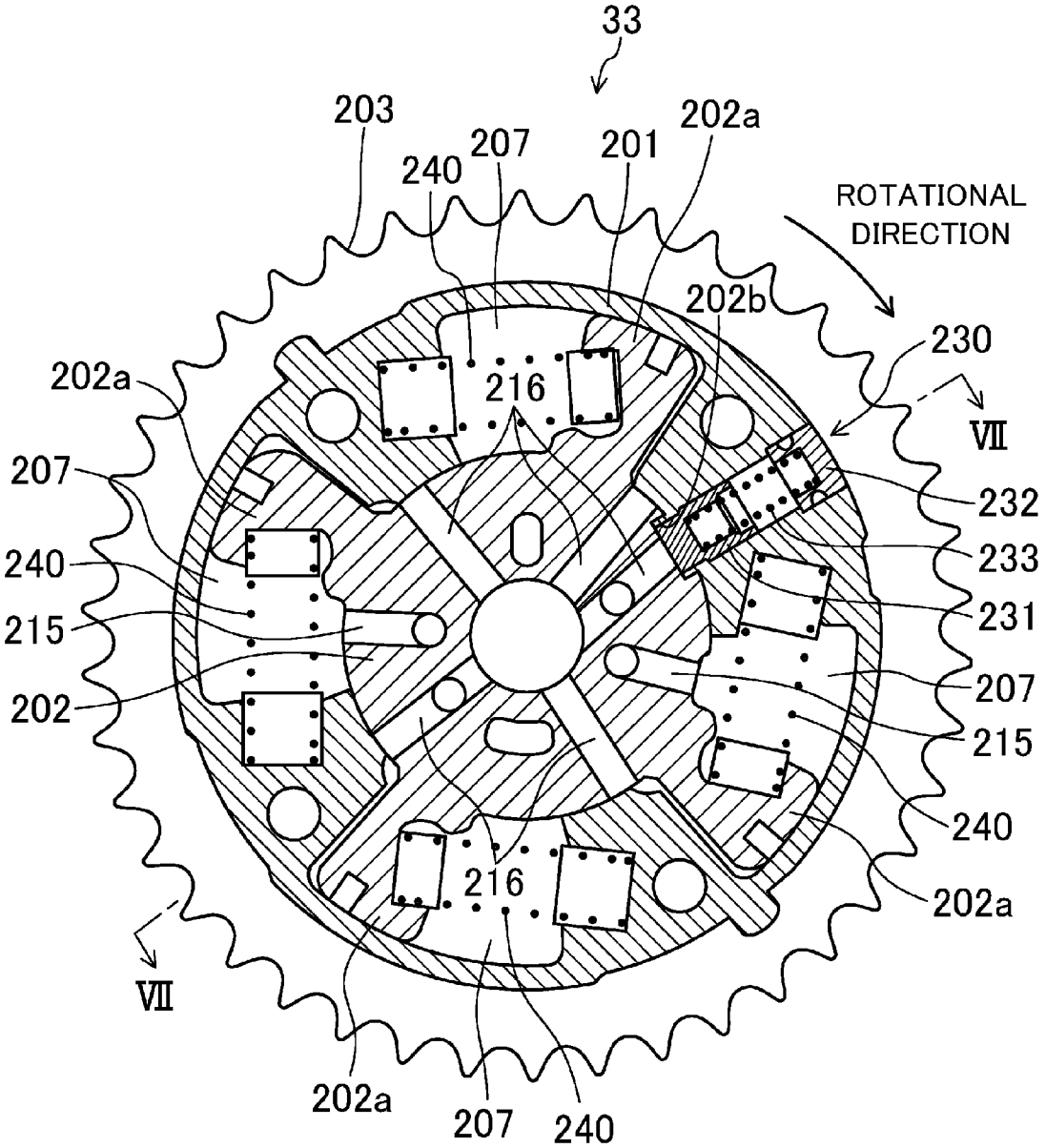
FIG. 5 is a cross-section of an exhaust-side variable valve timing mechanism, taken along a plane perpendicular to a camshaft, for showing a vane body (the camshaft) locked by a locking pin of a locking mechanism.
Figure 6:
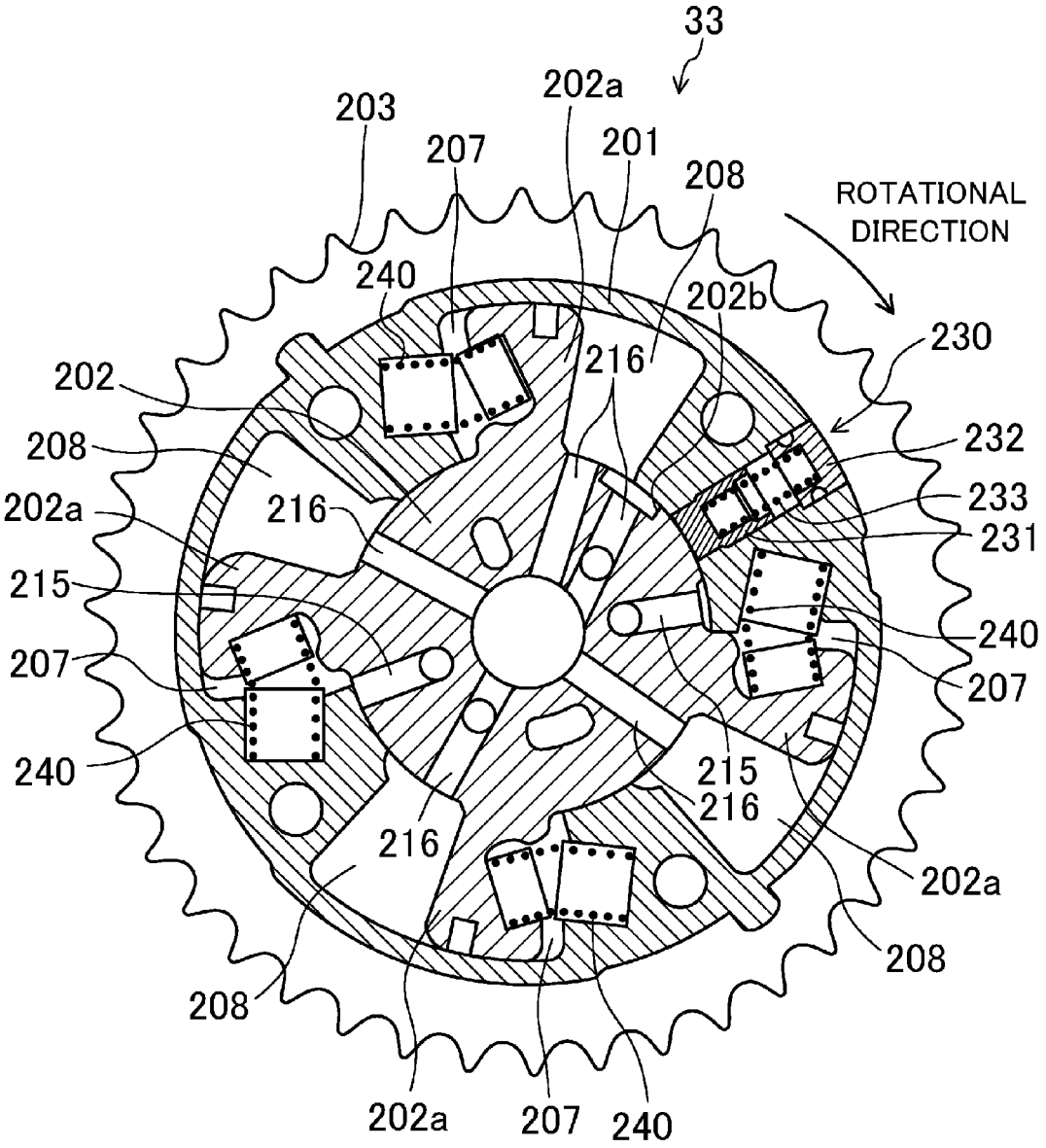
FIG. 6 corresponds to FIG. 5, and illustrates a state in which the locking pin of the locking mechanism is released from the locking state and in which the vane body turns in a retarded angle direction with respect to housing.
Figure 7:
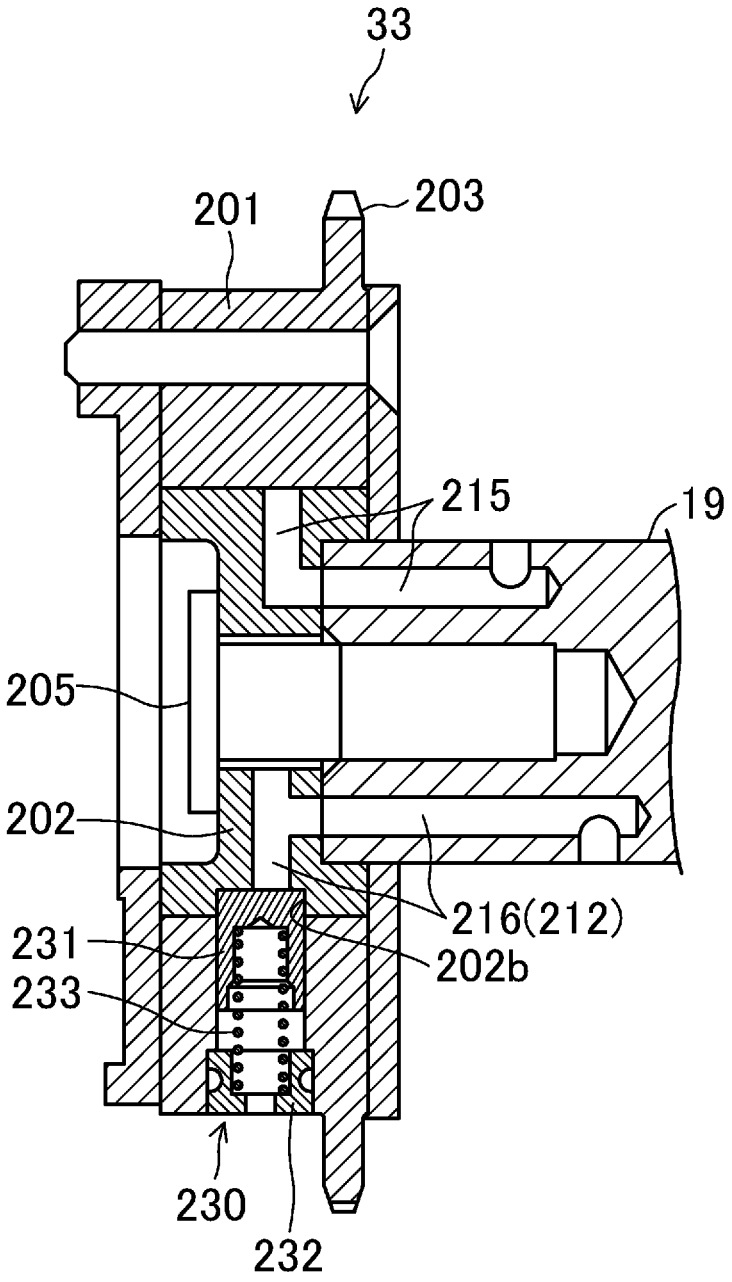
FIG. 7 is a cross-section taken along the VII-VII plane in FIG. 5.

FIGS. 5-7 illustrate an exhaust-side variable valve timing mechanism 33 (hereinafter abbreviated as a "VVT 33"), which is an example of the hydraulically-actuated device. The configurations of the VVT 33 are the same as, or similar to, the configurations of the VVT 32. Thus, the same reference characters are used to designate the same elements as those of the VVT 32, and the detailed description thereof is omitted.

The locking mechanism 230 of the VVT 33, too, has a locking pin 231 for fixing a phase angle of the camshaft 19 relative to the crankshaft 9 to a particular phase angle. Unlike the VVT 32, the particular phase angle is a most advanced phase angle in the present embodiment. However, the particular phase angle is not limited thereto, and may be any phase angle. One of the plurality of retarded angle side passages 216 each extending radially from near the center of the vane body 202 is connected to the bottom of a fitting recess 202*b* to which the locking pin 231 is fitted. The one of the plurality of retarded angle side passages 216 communicates with one of the plurality of retarded angle chambers 208 through the fitting recess 202*b*.

The advanced angle chambers 207 and the retarded angle chambers 208 of the VVT 33 are connected to an exhaust-side first direction switching valve 35, which is a hydraulic control valve, via the advanced angle side oil passage 211 and the retarded angle side oil passage 212, respectively. The exhaust-side first direction switching valve 35 is connected to the variable displacement oil pump 36 (see FIG. 8). Control of the exhaust-side first direction switching valve 35 enables control of an amount of oil supplied to the advanced angle chambers 207 and the retarded angle chambers 208 of the VVT 33. If the exhaust-side first direction switching valve 35 is controlled to supply a larger amount of oil (higher oil pressure) to the advanced angle chambers 207 than to the retarded angle chambers 208, the camshaft 19 turns in the rotational direction thereof (the direction indicated by the arrows in FIGS. 5 and 6). Thus, the opening timing of the exhaust valve 15 is advanced, and the locking pin 231 is fitted in the fitting recess 202*b* when the camshaft 19 is positioned at its most advanced angle (see FIG. 5). On the other hand, if the exhaust-side first direction switching valve 35 is controlled to supply a larger amount of oil (higher oil pressure) to the retarded angle chambers 208 than to the advanced angle chambers 207, the camshaft 19 turns opposite the rotational direction, and the opening timing of the exhaust valve 15 is retarded (see FIG. 6). To retard the camshaft 19 from its most advanced angle, the locking pin 231 is pushed radially outward of the housing 201 against the locking pin biasing spring 233, using oil pressure, thereby releasing the locking pin 231 from the locking state. At this moment, the retarded angle chambers 208 other than the retarded angle chamber 208 communicating with the fitting recess 202*b* have already been filled with oil. Thus, the opening timing of the exhaust valve 15 can be retarded by controlling the exhaust-side first direction switching valve 35 and turning the camshaft 19 opposite the rotational direction soon after the release of the locking pin 231 from the locking state. Note that to release the locking pin 231 of the VVT 33 from the locking state, oil pressure greater than the biasing force of the locking pin biasing spring 233 needs to be supplied to the retarded angle chambers 208. This oil pressure can be obtained by controlling the exhaust-side first direction switching valve 35, and also by controlling an oil discharge amount of the variable displacement oil pump 36. Supplying this oil pressure to the retarded angle chambers 208 and supplying an oil pressure (basically, oil pressure close to 0) lower than this oil pressure to the advanced angle chambers 207 make the camshaft 19 turn opposite the rotational direction and move away from the locking position soon after the release of the locking pin 231 from the locking state. The exhaust-side first direction switching valve 35 is then controlled to control the valve-opening phase of the exhaust valve 15.

Unlike the VVT 32, a compression coil spring 240 is provided in a space (i.e., the advanced angle chamber 207) formed between each vane 202*a* of the VVT 33 and a portion of the housing 201 opposed to the vane 202*a* in the rotational direction of the camshaft 19. The compression coil springs 240 bias the vane body 202 toward the advance angle side to assist the movement of the vane body 202 toward the advance angle side. The compression coil springs 240 are provided to overcome the load applied to the camshaft 19 from a fuel pump 81 and a vacuum pump 82 (see FIG. 8), which will be described later, and provide a reliable movement of the vane body 202 to its most advanced angle position (i.e., to have the locking pin 231 reliably fitted to the fitting recess 202*b*).

When the VVT 32 (and/or VVT 33) changes the valve-opening phase of the intake valve 14 in the advanced angle direction (and/or changes the valve-opening phase of the exhaust valve 15 in the retarded angle direction), the valve-opening period of the exhaust valve 15 and the valve-opening period of the intake valve 14 overlap with each other. In particular, the overlap between the valve-opening periods of the intake valve 14 and the exhaust valve 15 by changing the valve-opening phase of the intake valve 14 in the advanced angle direction may increase the internal EGR at the engine combustion, and also reduce pumping losses, thereby improving the fuel efficiency. Such overlap may also reduce a rise of the combustion temperature, thereby reducing the generation of NOx and hence cleaning the exhaust gas. On the other hand, the length of overlapping period between the valve-opening periods of the intake valve 14 and the exhaust valve 15 decreases when the VVT 32 (and/or VVT 33) changes the valve-opening phase of the intake valve 14 in the retarded angle direction (and/or changes the valve-opening phase of the exhaust valve 15 in the advanced angle direction). This may ensure stable combustion at low load operation, such as at idle, in which the engine load is less than or equal to a predetermined value.

In the present embodiment, the valve-opening periods of the intake valve 14 and the exhaust valve 15 are made to overlap with each other at low load operation, too, so as to maximize the length of overlapping period at high load operation.

Figure 8:
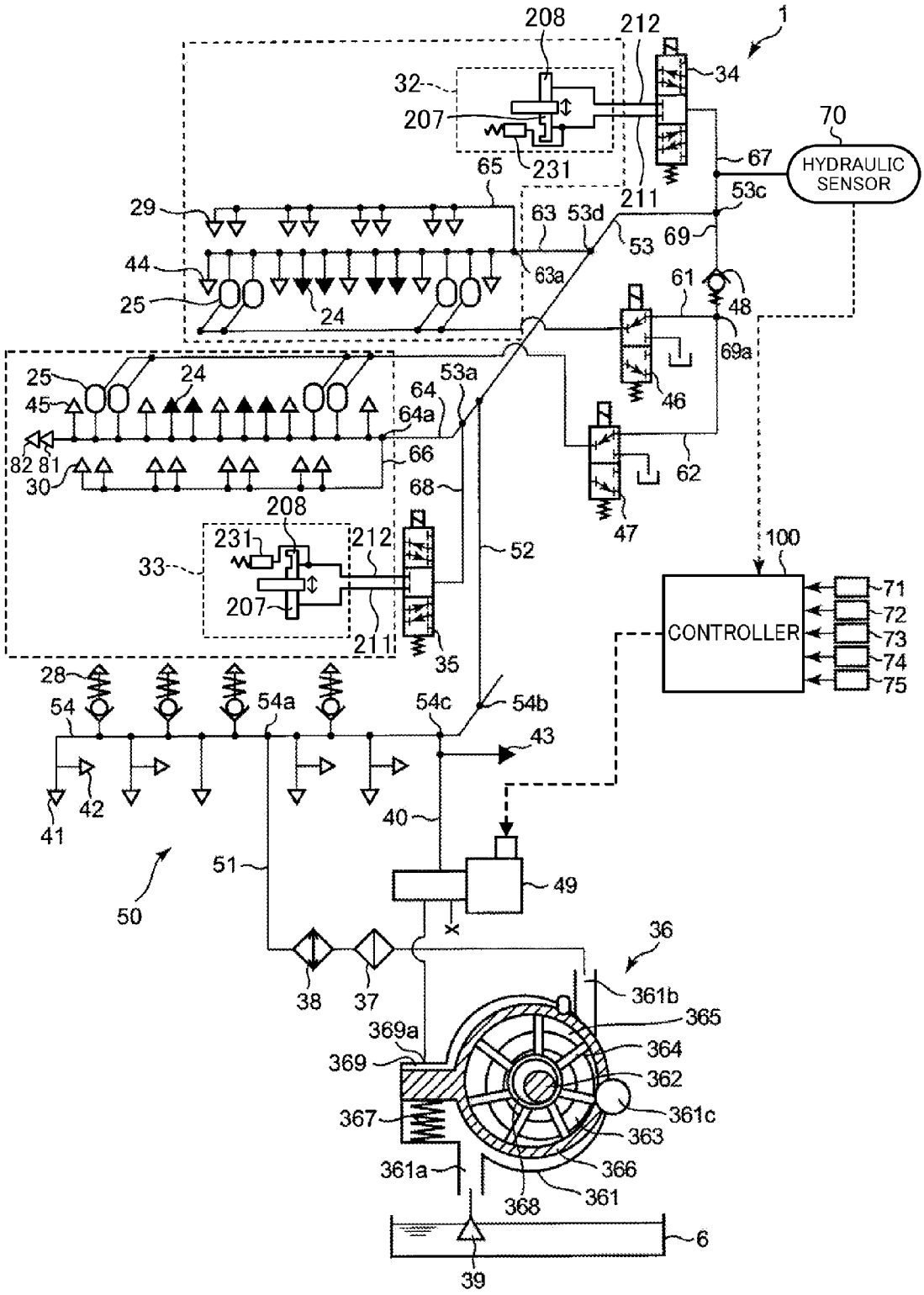
FIG. 8 illustrates a general configuration of an oil feed device.

Now, an oil feed device 1 which feeds the oil to the above-described engine 2 will be described in detail with reference to FIG. 8. As illustrated in FIG. 8, the oil feed device 1 has a variable displacement oil pump 36 (hereinafter referred to as an "oil pump 36") rotatably driven by the rotation of the crankshaft 9, and an oil feed passage 50 (a hydraulic path) which is connected to the oil pump 36 to lead the oil having a pressure raised by the oil pump 36 to lubricated parts and hydraulically-actuated devices of the engine 2. The oil pump 36 is an accessory driven by the engine 2.

The oil feed passage 50 is formed of a pipe or any other passages formed in the cylinder head 4 or the cylinder block 5. The oil feed passage 50 is connected to the oil pump 36. The oil feed passage 50 includes a first connecting path 51 extending from the oil pump 36 (specifically extending from an discharge port 361*b*, which will be described later) to a branch point 54*a* in the cylinder block 5, the aforementioned main gallery 54 extending in the cylinder arrangement direction in the cylinder block 5, a second connecting path 52 extending from a branch point 54*b* at the main gallery 54 to the cylinder head 4, a third connecting path 53 extending approximately horizontally in the cylinder head 4 from the intake-side to the exhaust-side of the cylinder head 4, and a plurality of oil passages 61-69 which branch, in the cylinder head 4, from the third connecting path 53.

The oil pump 36 is a known variable displacement oil pump which changes the capacity of itself to discharge variable amount of oil from the oil pump 36. The oil pump 36 includes: a housing 361 comprised of a pump body having a pump-accommodating chamber whose interior has a circular cross-section and whose one end is open, and a cover member that closes the one end of the pump body; a drive shaft 362 rotatably supported on the housing 361, passing through approximately the center of the pump-accommodating chamber, and rotatably driven by the crankshaft 9; a pump element comprised of a rotor 363 rotatably accommodated in the pump-accommodating chamber and having a central portion coupled to the drive shaft 362, and vanes 364 accommodated in a plurality of slits, which are formed radially in the outer periphery of the rotor 363, in such a manner that allows the vanes 364 to come out and come in freely; a cam ring 366 arranged on the outer periphery of the pump element so as to be able to eccentric with the rotation center of the rotor 363, and the cam ring 366 defining a plurality of pump chambers 365, which are hydraulic oil chambers, together with the rotor 363 and the vanes 364 adjacent to each other; a spring 367, which is a biasing member, housed in the pump body and biasing the cam ring 366 all the time in a direction that increases the eccentricity of the cam ring 366 with respect to the rotation center of the rotor 363; and a pair of ring members 368 slidably arranged at lateral portions of the inner periphery of the rotor 363 and each having a smaller diameter than the rotor 363. The housing 361 is provided with an inlet port 361*a* trough which oil is fed to the pump chambers 365 formed in the interior of the housing 361, and a discharge port 361*b* through which the oil is discharged from the pump chambers 365. The interior of the housing 361 is provided with a pressure chamber 369 defined by the inner peripheral surface of the housing 361 and the outer peripheral surface of the cam ring 366. The housing 361 is provided with an introduction hole 369*a* open to the pressure chamber 369. In the oil pump 36, when the oil is introduced in the pressure chamber 369 through the introduction hole 369*a*, the cam ring 366 pivots on a fulcrum point 361*c*, which causes the rotor 363 to be relatively eccentric with the cam ring 366, and the amount of oil discharged by the oil pump 36 is accordingly varied.

An oil strainer 39 is connected to the inlet port 361*a* of the oil pump 36. The oil strainer 39 faces the oil pan 6. The first connecting path 51 which communicates with the discharge port 361*b* of the oil pump 36 is provided with an oil filter 37 and an oil cooler 38 sequentially arranged from the upstream side to the downstream side. The oil accumulated in the oil pan 6 is pumped by the oil pump 36 through the oil strainer 39, and then filtered by the oil filter 37 and cooled by the oil cooler 38, and introduced into the main gallery 54 formed in the cylinder block 5.

The main gallery 54 is connected to the aforementioned oil jet 28 for injecting oil to the back sides of the four pistons 8 to cool the pistons 8, oil-fed portions 41 of metal bearings arranged at five main journals which rotatably support the crankshaft 9, and oil-fed portions 42 of metal bearings arranged at crankpins of the crankshaft 9 which connect four connecting rods in a rotatable manner Oil is fed to the main gallery 54 all the time.

An oil feeder 43 which feeds oil to a hydraulic chain tensioner, and an oil passage 40 which feeds oil to the pressure chamber 369 of the oil pump 36 from the introduction hole 369*a* through a linear solenoid valve 49, are connected to the downstream of a branch point 54*c* at the main gallery 54.

An oil passage 68 which branches from a branch point 53*a* of the third connecting path 53 is connected to the exhaust-side first direction switching valve 35. By controlling the exhaust-side first direction switching valve 35, oil is fed to each of the advance angle hydraulic chambers 207 and the retarded angle hydraulic chambers 208 of the exhaust-side VVT 33 via the advanced angle side oil passage 211 and the retarded angle side oil passage 212. The exhaust-side first direction switching valve 35 is disposed at a hydraulic path leading to the aforementioned hydraulically-actuated devices from the oil pump 36. The exhaust-side first direction switching valve 35 is a hydraulic control valve which controls the oil pressure to be supplied to the locking mechanism 230, advanced angle chambers 207, and retarded angle chambers 208 of the exhaust-side VVT 33. Further, an oil passage 64 which branches from the branch point 53*a* is connected to: oil-fed portions 45 (see the white triangles in FIG. 8) of metal bearings provided at cam journals of the exhaust-side camshaft 1; the HLAs 24 (see the black triangles in FIG. 8); the HLAs 25 with valve stop system (see the white ovals in FIG. 8); the fuel pump 81 driven by the camshaft 19 to feed a high-pressure fuel to a fuel injection valve which feeds the fuel to the combustion chamber 11; and the vacuum pump 82 driven by the camshaft 19 to ensure the pressure in a brake master cylinder. Oil is fed to the oil passage 64 all the time. Further, an oil passage 66 which branches from a branch point 64*a* of the oil passage 64 is connected to an oil shower 30 which feeds the oil for lubrication to a swing arm 21 on the exhaust-side. Oil is fed to the oil passage 66 all the time.

The elements on the intake-side have the same configurations as those on the exhaust-side. An oil passage 67 which branches from a branch point 53*c* of the third connecting path 53 is connected to the intake-side first direction switching valve 34. By controlling the intake-side first direction switching valve 34, oil is fed to each of the advance angle hydraulic chambers 207 and the retarded angle hydraulic chambers 208 of the intake-side VVT 32 via the advanced angle side oil passage 211 and the retarded angle side oil passage 212. The intake-side first direction switching valve 34, too, is disposed at a hydraulic path leading to the aforementioned hydraulically-actuated devices from the oil pump 36. The intake-side first direction switching valve 34 is a hydraulic control valve which controls the oil pressure to be supplied to the locking mechanism 230, advanced angle chambers 207, and retarded angle chambers 208 of the intake-side VVT 32. The oil passage 67 (i.e., a hydraulic path which feeds oil to only the intake-side VVT 32) is provided with a hydraulic sensor 70 which detects the oil pressure in the oil passage 67. The hydraulic sensor 70 detects the pressure of the oil in the hydraulic path leading to the aforementioned hydraulically-actuated devices from the oil pump 36, at a portion closer to the oil pump 36 from the exhaust-side first direction switching valve 35 and the intake-side first direction switching valve 34. Further, an oil passage 63 which branches from a branch point 53*d* is connected to oil-fed portions 44 (see the white triangles in FIG. 8) of metal bearings provided at cam journals of the intake-side camshaft 18, the HLAs 24 (see the black triangles in FIG. 8), and HLAs 25 with valve stop system (see the white ovals in FIG. 8). Further, an oil passage 65 which branches from a branch point 63*a* of the oil passage 63 is connected to the oil shower 29 which feeds the oil for lubrication to a swing arm 20 on the intake-side.

An oil passage 69 which branches from the branch point 53*c* of the third connecting path 53 is provided with a check valve 48 which restricts the oil flow to only one direction, that is, from upstream to downstream direction. The oil passage 69 branches into two oil passages 61, 62 at a branch point 69*a* located downstream of the check valve 48. The oil passages 61, 62 communicate with the attachment holes 26, 27 for attaching the HLA 25 with valve stop system. The oil passages 61, 62 are respectively connected to the valve stop systems of the intake-side and exhaust-side HLAs 25, via an intake-side second direction switching valve 46 and an exhaust-side second direction switching valve 47. Oil is fed to the respective valve stop systems by controlling the intake-side and exhaust-side second direction switching valves 46, 47.

The oil for lubrication and cooling which has been fed to the metal bearings rotatably supporting the crankshaft 9 and the camshafts 18, 19, and to the piston 8, the camshafts 18, 19, etc., drops into the oil pan 6 through a drain oil passage, not shown, after lubrication and cooling, and is recirculated by the oil pump 36.

The actuation of the engine 2 is controlled by a controller 100. The information detected by various sensors which detect the operational state of the engine 2 is input to the controller 100. For example, the controller 100 detects an engine rotational speed from a detection signal transmitted from a crank angle sensor 71 detecting a rotational angle of the crankshaft 9. The controller 100 also detects the engine load from a detection signal from a throttle position sensor 72 detecting an amount of accelerator pedal depression (an accelerator opening) depressed by an occupant of the vehicle on which the engine 2 is mounted. Further, a pressure in the oil passage 67 is detected from the aforementioned sensor 70. An oil temperature in the oil passage 67 is detected from an oil temperature sensor 73 provided at approximately the same position of the hydraulic sensor 70. The hydraulic sensor 70 may be provided at any position of the oil feed passage 50. In addition, the oil temperature sensor 73 may be provided at any position of the oil feed passage 50 (may be provided at a different position from the position where the hydraulic sensor 70 is provided). A cam angle sensor 74 provided near the camshaft 18, 19 detects a rotational phase of the camshaft 18, 19. A phase angle of the VVT 32, 33 is detected based on this cam angle. A water temperature sensor 75 detects a temperature of cooling water (hereinafter referred to as a "water temperature") for cooling the engine 2.

The controller 100 includes a known microcomputer as a base, and is comprised of a signal input section which receives detection signals from various sensors (e.g., the hydraulic sensor 70, a crank position sensor 71, the throttle position sensor 72, the oil temperature sensor 73, the cam angle sensor 74, the water temperature sensor 75), an arithmetic section which perform arithmetic operations relating to control, a signal output section which outputs a control signal to devices to be controlled (e.g., the intake-side and exhaust-side first direction switching valves 34, 35, the intake-side and exhaust-side second direction switching valves 46, 47, and the linear solenoid valve 49), and a storage section which stores programs and data (e.g., a hydraulic control map and a duty ratio map, which will be described later) necessary for control.

The linear solenoid valve 49 is a flow rate (i.e., a discharge amount) control valve for controlling the discharge amount of the oil pump 36 according to the operational state of the engine 2. Oil is fed to the pressure chamber 369 of the oil pump 36 while the linear solenoid valve 49 is open. Description of the linear solenoid valve 49 is omitted since the linear solenoid valve 49 has a known configuration. The flow rate (i.e., discharge amount) control valve is not limited to the linear solenoid valve 49. An electromagnetic control valve may also be used as the flow rate (i.e., discharge amount) control valve, for example.

Figure 9:
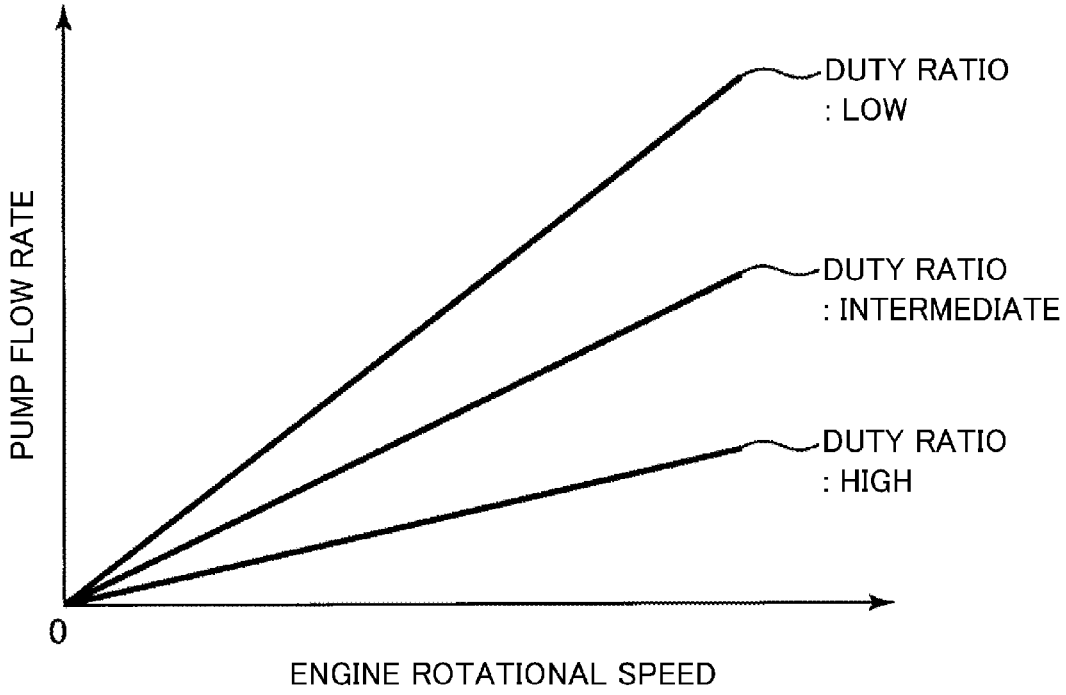
FIG. 9 shows characteristics of a variable displacement oil pump.

The controller 100 transmits a signal for controlling a duty ratio according to the operational state of the engine 2 to the linear solenoid valve 49, thereby controlling, via the linear solenoid valve 49, the pressure of the oil to be fed to the pressure chamber 369 of the oil pump 36. The flow rate (i.e., the discharge amount) of the oil pump 36 is controlled by controlling, using the oil pressure of the pressure chamber 369, the eccentricity of the cam ring 366, and hence the amount of change of the internal capacity of the pump chambers 365. In other words, the capacity of the oil pump 36 is controlled based on the duty ratio. Since the oil pump 36 is driven by the crankshaft 9 of the engine 2, the flow rate (i.e., the discharge amount) of the oil pump 36 is proportional to the engine rotational speed (i.e., the number of rotations of the pump) as shown in FIG. 9. If the duty ratio refers to a proportion of a period when the linear solenoid valve 49 is active, to a period of one cycle, the greater the duty ratio is, the greater the oil pressure fed to the pressure chamber 369 of the oil pump 36 becomes, and hence the smaller the inclination of the flow rate of the oil pump 36 with respect to the engine rotational speed becomes, as shown in FIG. 9.

Now, the reduced cylinder operation of the engine 2 will be described with reference to FIGS. 10A and 10B. The operation of the engine 2 is switched between the reduced cylinder operation and the full cylinder operation, depending on the operational state of the engine 2. Specifically, the reduced cylinder operation is executed if the operational state of the engine 2 known from the engine rotational speed, engine loads, and the water temperature of the engine 2 is in the reduced cylinder operation region shown in FIGS. 10A and 10B. A reduced cylinder operation preparation region is provided next to the reduced cylinder operation region as shown in the figures. If the operational state of the engine 2 is in the reduced cylinder operation preparation region, the oil pressure is raised in advance toward the oil pressure required by the valve stop system so as to be ready for the execution of the reduced cylinder operation. The full cylinder operation is executed if the operational state of the engine 2 is outside the reduced cylinder operation region and the reduced cylinder operation preparation region.

Figure 10A:
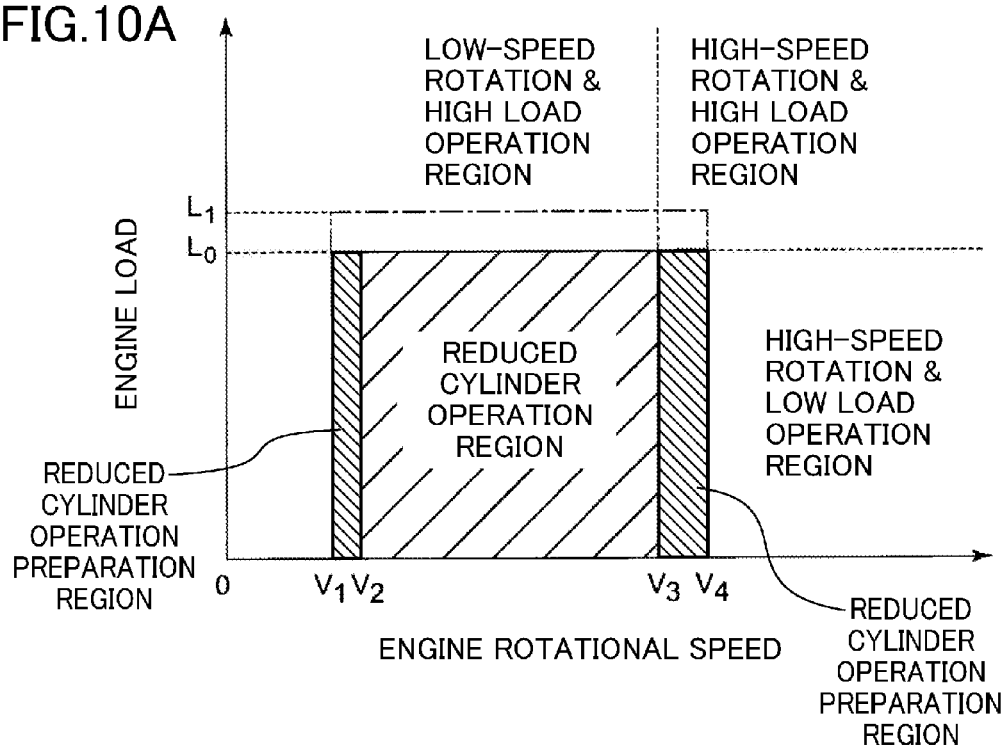
FIG. 10A shows a region of reduced cylinder operation of the engine based on a relationship between the engine rotational speed and the engine load.

As shown in FIG. 10A, if the engine 2 is accelerated at a predetermined engine load (less than or equal to L0) and the engine rotational speed increases, the full cylinder operation is performed when the engine rotational speed is less than a predetermined rotational speed V1. The preparation of the reduced cylinder operation starts when the engine rotational speed is more than or equal to V1 and less than V2 (>V1). The reduced cylinder operation is performed when the engine rotational speed is more than or equal to V2. Similarly, if the engine 2 is decelerated at a predetermined engine load (less than or equal to L0), for example, and the engine rotational speed decreases, the full cylinder operation is performed when the engine rotational speed is more than or equal to V4. The preparation of the reduced cylinder operation starts when the engine rotational speed is more than or equal to V3 (<V4) and less than V4. The reduced cylinder operation is performed when the engine rotational speed is less than or equal to V3.

Figure 10B:
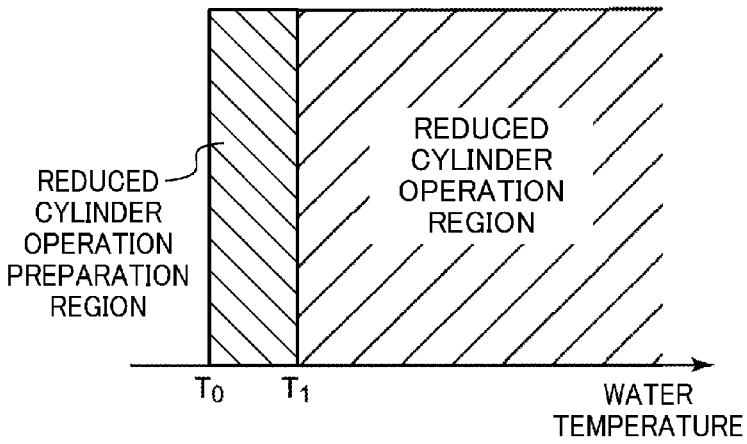
FIG. 10B shows a region of reduced cylinder operation of the engine based on a relationship with the engine's water temperature.

As shown in FIG. 10B, if the vehicle runs at a predetermined engine rotational speed (more than or equal to V2 and less than or equal to V3) and at a predetermined engine load (less than or equal to L0), and the engine 2 warms up and the water temperature increases, the full cylinder operation is performed when the water temperature is lower than T0. The preparation of the reduced cylinder operation starts when the water temperature is higher than or equal to T0 and lower than T1. The reduced cylinder operation is performed when the water temperature is higher than or equal to T1.

If the reduced cylinder operation preparation region was not provided, the oil pressure would not be raised toward the oil pressure required by the valve stop system until the operational state of the engine 2 entered the reduced cylinder operation region, in switching the full cylinder operation to the reduced cylinder operation. In this configuration, a length of period of the reduced cylinder operation is shortened by the length of period until the oil pressure reaches the required oil pressure. As a result, the fuel efficiency of the engine 2 is reduced by the length of reduction of the reduced cylinder operation.

In view of this, the present embodiment provides the reduced cylinder operation preparation region next to the reduced cylinder operation region to maximize the fuel efficiency of the engine 2. The oil pressure is raised in advance in the reduced cylinder operation preparation region, and a target oil pressure (see FIG. 11A) is determined such that the loss of time, that is, the length of period until the oil pressure reaches the required oil pressure, be eliminated.

The reduced cylinder operation preparation region may be a region provided next to the reduced cylinder operation region on the higher engine load side as shown in FIG. 10A, that is, the region indicated by a dot-dash line. With this configuration, if, for example, the engine load goes down at a predetermined engine rotational speed (more than or equal to V2 and less than or equal to V3), the full cylinder operation may be performed when the engine load is more than or equal to L1 (>L0); the preparation of the reduced cylinder operation may start when the engine load is more than or equal to L0 and less than L1; and the reduced cylinder operation may be performed when the engine load is less than or equal to L0.

Described below with reference to FIG. 11 are the oil pressures required by the respective hydraulically-actuated devices (which include, in the present embodiment, the oil jet 28 and the metal bearings, such as journals of the crankshaft 9, in addition to the valve stop system and the VVTs 32, 33) and the target oil pressure of the oil pump 36. The oil feed device 1 of the present embodiment feeds oil to a plurality of hydraulically-actuated devices, using a single oil pump 36. The oil pressures required by the respective hydraulically-actuated devices vary according to the operational state of the engine 2. Thus, in order to achieve the oil pressure required by any of the hydraulically-actuated devices in any of the operational states of the engine 2, an oil pressure greater than or equal to the highest oil pressure of all the oil pressures required by the respective hydraulically-actuated devices for each operational state of the engine 2 needs to be determined as a target oil pressure of the oil pump 36 corresponding to the operational state of the engine 2. Thus, in the present embodiment, the target oil pressure may be determined so as to satisfy the oil pressures required by the valve stop system, the oil jet 28, the metal bearings such as journals of the crankshaft 9, and the VVTs 32, 33, all of which require relatively high oil pressures among all of the hydraulically-actuated devices. The target oil pressure determined in this manner satisfies the oil pressures required by the other hydraulically-actuated devices which require relatively low oil pressures.

As shown in FIG. 11A, the VVTs 32, 33, the metal bearings, and the valve stop system are the hydraulically-actuated devices which require relatively high oil pressures in a low load operation of the engine 2. The oil pressures required by these hydraulically-actuated devices vary according to the operational state of the engine 2. For example, the oil pressures required by the VVTs 32, 33 (referred to as "OIL PRESSURE REQUIRED BY VTT" in FIG. 11) is approximately constant at the engine rotational speed of more than or equal to V0 (<V1). The oil pressure required by the metal bearings (referred to as "OIL PRESSURE REQUIRED BY METAL BEARING" in FIG. 11) increases as the engine rotational speed increases. The oil pressure required by the valve stop system (referred to as "OIL PRESSURE REQUIRED TO STOP VALVE" in FIG. 11) is approximately constant at engine rotational speeds (V2-V3) which fall within a predetermined range. Comparison between these required oil pressures in terms of the magnitude thereof at the respective engine rotational speeds shows: there is only the oil pressure required by the metal bearing when the engine rotational speed is lower than V0; the oil pressure required by VVT is the highest pressure when the engine rotational speed is V0-V2; the oil pressure required to stop valve is the highest pressure when the engine rotational speed is V2-V3; the oil pressure required by VVT is the highest pressure when the engine rotational speed is V3-V6; and the oil pressure required by metal bearing is the highest pressure when the engine rotational speed is higher than or equal to V6. Thus, the target oil pressure of the oil pump 36 needs to be determined based on the highest required oil pressure at the respective engine rotational speeds as a reference target oil pressure.

In the ranges of the engine rotational speeds (V1-V2 and V3-V4) before and after the range of the engine rotational speeds (V2-V3) at which the reduced cylinder operation is performed, the target oil pressure is determined by adjusting the reference target oil pressure such that the oil pressure is raised in advance toward the "oil pressure required to stop valve" for the preparation for the reduced cylinder operation. As explained in the description of FIG. 10, this configuration eliminates the loss of time, that is, the length of period until the oil pressure reaches the "oil pressure required to stop valve" when the engine rotational speed turns to such an engine rotational speed at which the reduced cylinder operation is performed. As a result, the fuel efficiency of the engine 2 is increased. An example of the target oil pressure of the oil pump 36 (referred to as "TARGET OIL PRESSURE OF THE OIL PUMP" in FIG. 11) which is obtained by the above adjustment is shown in bold line (V1-V2, V3-V4) in FIG. 11A.

Further, considering response delay or overload of the oil pump 36, it is recommended that in the aforementioned adjustment for the preparation of the reduced cylinder operation, the target oil pressure be adjusted such that it gradually increases or decreases according to the operational speed of the engine within a range higher than or equal to a required oil pressure, in order to reduce the magnitude of changes of the oil pressure at such engine rotational speeds (e.g., V0, V1, V4) at which the required oil pressure abruptly changes in relation to the engine rotational speeds. This adjusted oil pressure may be determined as a target oil pressure. An example target oil pressure determined by this adjustment is shown in bold line in FIG. 11A (less than or equal to V0, V0-V1, and V4-V5).

As shown in FIG. 11B, the VVTs 32, 33, the metal bearings and the oil jet 28 are the hydraulically-actuated devices which require relatively high oil pressures in a high load operation of the engine 2. Similarly to the case of the low load operation, the oil pressures required by these hydraulically-actuated devices vary according to the operational state of the engine 2. For example, the "oil pressure required by VVT" is approximately constant at the engine rotational speed of more than or equal to V0'. The "oil pressure required by metal bearing" increases as the engine rotational speed increases. The oil pressure required by the oil jet 28 is zero (0) at the engine rotational speed of lower than V2'. The oil pressure required by the oil jet 28 increases as the engine rotational speed increases from V2' to a certain rotational speed, and is constant at the certain rotational speed or higher.

In the case of the high load operation, too, like in the case of the low load operation, the reference target oil pressure may be adjusted in the region of the engine rotational speeds (e.g., V0', V2') at which the required oil pressure significantly changes with respect to the engine rotational speed, and such a reference target oil pressure that is adjusted may be set to the target oil pressure. An example of the target oil pressure of the oil pump 36 which has been determined through appropriate adjustment (particularly, adjustment in the region of less than or equal to V0' and the region of V1'-V2') is shown in bold line in FIG. 11B.

Changes in the target oil pressure of the oil pump 36 are represented by broken line as shown in the figures, but may also be represented by a smooth curve. Further, in the present embodiment, the target oil pressure is determined based on the oil pressures required by the valve stop system, the oil jet 28, the metal bearings and the VVTs 32, 33, which require relatively high oil pressure. However, the hydraulically-actuated devices taken into account in determining the target oil pressure are not limited to the above-listed devices, and may be any hydraulically-actuated devices requiring relatively high oil pressure. In such a case, too, the target oil pressure may be determined by taking the oil pressure required by the device into account.

Now, the hydraulic control map will be described with reference to FIG. 12. The target oil pressure of the oil pump 36 shown in FIG. 11 uses the engine rotational speed as a parameter. Shown in FIG. 12 is a hydraulic control map, which is a three dimensional graph using, as parameters, an engine load and an oil temperature in addition to the engine rotational speed. Specifically, in this hydraulic control map, target oil pressures corresponding to the respective operational states of the engine 2 (which include an oil temperature in addition to the rotational speed and the engine load in this example) are determined in advance, based on the highest oil pressure of the oil pressures required by the respective hydraulically-actuated devices for each of the operational states of the engine 2.

FIG. 12A, FIG. 12B and FIG. 12C show the hydraulic control maps when the engine 2 (i.e., the oil temperature) is at a high temperature, warm, and cold, respectively. The controller 100 uses different hydraulic control maps, depending on the oil temperature. Specifically, the controller 100 reads the target oil pressure corresponding to the operational state (i.e., the engine rotational speed and the engine load) of the engine 2, from the hydraulic control map of the cold state, shown in FIG. 12C, when the engine starts and still in the cold state (when the oil temperature is lower than T1). The controller 100 reads the target oil pressure from the hydraulic control map of the warm state, shown in FIG. 12B, when the engine 2 is warmed-up and the oil temperature reaches at higher than or equal to a predetermined temperature T1. The controller 100 reads the target oil pressure from the hydraulic control map of high temperature, shown in FIG. 12A, when the engine 2 is completely warmed-up and the oil temperature is higher than or equal to a predetermined temperature T2 (>T1).

In the present embodiment, the oil temperature is divided into three temperature ranges (i.e., the ranges of high temperature, and warm and cold states), and the target oil pressure is read from the hydraulic control maps determined in advance for the respective temperature ranges. The target oil pressure may also be read from a single hydraulic control map, without taking the oil temperature into account, or the oil temperature may be divided into more than three temperature ranges to have more hydraulic control maps. Further, in the present embodiment, if the oil temperature t is in the temperature range (e.g., $T1 \leq t < T2$) of a single hydraulic control map (e.g., the hydraulic control map for the warm state), the same target oil pressure P1 is read from the hydraulic control map. However, the target oil pressure p may be calculated by proportional conversion ($p=(t-T1)\times(P2-P1)/(T2-T1)$) based on the oil temperature t, taking the target oil pressure (P2) in the lower and/or higher temperature ranges ($T2 \leq t$) into account. Reading and calculating more accurate target oil pressure based on the oil temperature allow more accurate control of the pump capacity.

Now, the duty ratio map will be described with reference to FIG. 13. In the duty ratio map in this embodiment, target duty ratios corresponding to the respective operational states (i.e., the engine rotational speed, the engine load, and the oil temperature) of the engine 2 are determined in advance. To calculate the target duty ratios corresponding to the respective operational states, the target oil pressure of each of the operational states of the engine 2 is read from the aforementioned hydraulic control map. A target discharge amount of the oil fed from the oil pump 36 is determined based on the target oil pressure which has been read, while taking a flow path resistance, etc. into account. The target duty ratios corresponding to the respective operational states is calculated based on this target discharge amount, while taking the engine rotational speed (i.e., the number of rotations of the oil pump), for example, into account.

FIG. 13A, FIG. 13B and FIG. 13C show the duty ratio maps when the engine 2 (i.e., the oil temperature) is at a high temperature, warm, and cold, respectively. The controller 100 uses different duty ratio maps, depending on the oil temperature. Specifically, at the start of the engine 2, the controller 100 reads the duty ratio corresponding to the operational state (i.e., the engine rotational speed and the engine load) of the engine 2 from the duty ratio map of the cold state, shown in FIG. 13C, since the engine is still in the cold state at the start. The controller 100 reads the target duty ratio from the duty ratio map of the warm state, shown in FIG. 13B, when the engine 2 is warmed-up and the oil temperature reaches at higher than or equal to a predetermined oil temperature T1. The controller 100 reads the target duty ratio from the duty ratio map of high temperature, shown in FIG. 13A, when the engine 2 is completely warmed-up and the oil temperature is higher than or equal to a predetermined oil temperature T2 (>T1).

In the present embodiment, the oil temperature is divided into three temperature ranges (i.e., the ranges of high temperature, and warm and cold states), and the target duty ratio is read from the duty ratio maps determined in advance for the respective temperature ranges. Similarly to the case of the aforementioned hydraulic control maps, the target duty ratio may also be read from a single duty ratio map, or the temperature ranges may be divided into more than three temperature ranges to have more duty ratio maps, or the target duty ratio may be calculated by proportional conversion based on the oil temperature.

In the present embodiment, a target oil pressure for each of the operational states of the engine 2 is read from the hydraulic control map in which target oil pressures corresponding to the operational state are determined in advance, based on the highest oil pressure of the oil pressures required by the respective hydraulically-actuated devices for each operational state of the engine 2. The discharge amount of the oil pump 36 is controlled by the linear solenoid valve 49 so that the oil pressure detected by the hydraulic sensor 70 will be the target oil pressure. Alternatively, the information of the required oil pressures of the respective hydraulically-actuated devices corresponding to the respective operational states of the engine 2 may be stored in the storage section of the controller 100 in advance. In such a case, the information of the required oil pressures of the respective hydraulically-actuated devices is read from the storage section, for each operational state of the engine 2. Comparison calculation is performed to obtain the highest required oil pressure, which is determined as a target oil pressure. The discharge amount of the oil pump 36 is controlled by the linear solenoid valve 49 so that the oil pressure detected by the hydraulic sensor 70 will be the target oil pressure.

Figure 14:
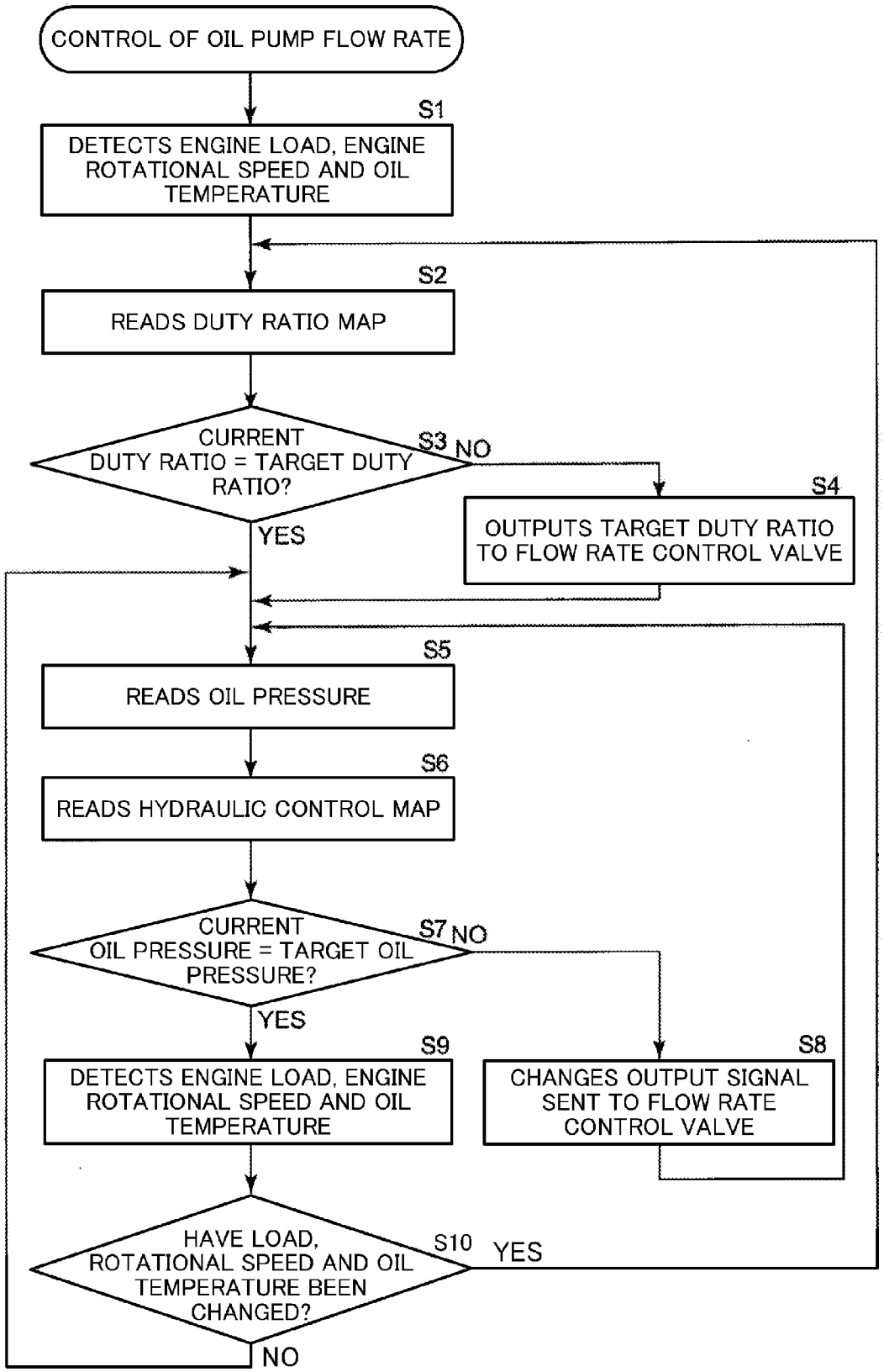
FIG. 14 is a flowchart showing control operation of a controller on a flow rate (i.e., a discharge amount) of the oil pump.

Now, the control operation of the flow rate (i.e., the discharge amount) of the oil pump 36 by the controller 100 will be described with reference to the flowchart in FIG. 14.

First, in Step S1, the controller 100 reads, from various sensors, information detected by the sensors, thereby detecting the engine load, the engine rotational speed, the oil temperature, etc., to acquire the operational state of the engine 2.

Then, in Step S2, the duty ratio map stored in advance in the controller 100 is read to read the target duty ratio corresponding to the engine load, the engine rotational speed, and the oil temperature which have been read in Step S1.

In the subsequent Step S3, the controller 100 determines whether the current duty ratio is the same as the target duty ratio read in Step S2 or not. If the determination of Step S3 is YES, the process goes to Step S5. On the other hand, if the determination in Step S3 is NO, the process goes to Step S4, in which a signal indicating the target duty ratio is output to the linear solenoid valve 49 (which is referred to as "FLOW RATE CONTROL VALVE" in the flowchart of FIG. 14), and goes to Step S5 thereafter.

In Step S5, the current oil pressure is read from the hydraulic sensor 70. In the subsequent Step S6, the hydraulic control map stored in advance is read. The target oil pressure corresponding to the current operational state of the engine is read from this hydraulic control map.

In the subsequent Step S7, the controller 100 determines whether the current oil pressure is the same as the target oil pressure read in Step S6 or not. If the determination in Step S7 is NO, the process goes to Step S8, in which a signal indicating the target duty ratio with a predetermined degree of change is output to the linear solenoid valve 49, and returns to Step S5 thereafter. In other words, the discharge amount of the oil pump 36 is controlled so that the oil pressure detected by the hydraulic sensor 70 will be the same as the target oil pressure.

On the other hand, if the determination in Step S7 is YES, the process goes to Step S9, in which the engine load, the engine rotational speed and the oil temperature are detected. In the subsequent Step S10, the controller 100 determines whether the engine load, the engine rotational speed and the oil temperature have been changed or not.

If the determination in Step S10 is YES, the process returns to Step S2. If the determination in Step S10 is NO, the process returns to Step S5. The above flow rate control continues until the engine 2 stops.

The above control of the flow rate of the oil pump 36 is a combination of the feedforward control of the duty ratio and the feedback control of the oil pressure. In this flow rate control, responsibility and accuracy are improved due to the feedforward control and the feedback control, respectively.

Figure 15:
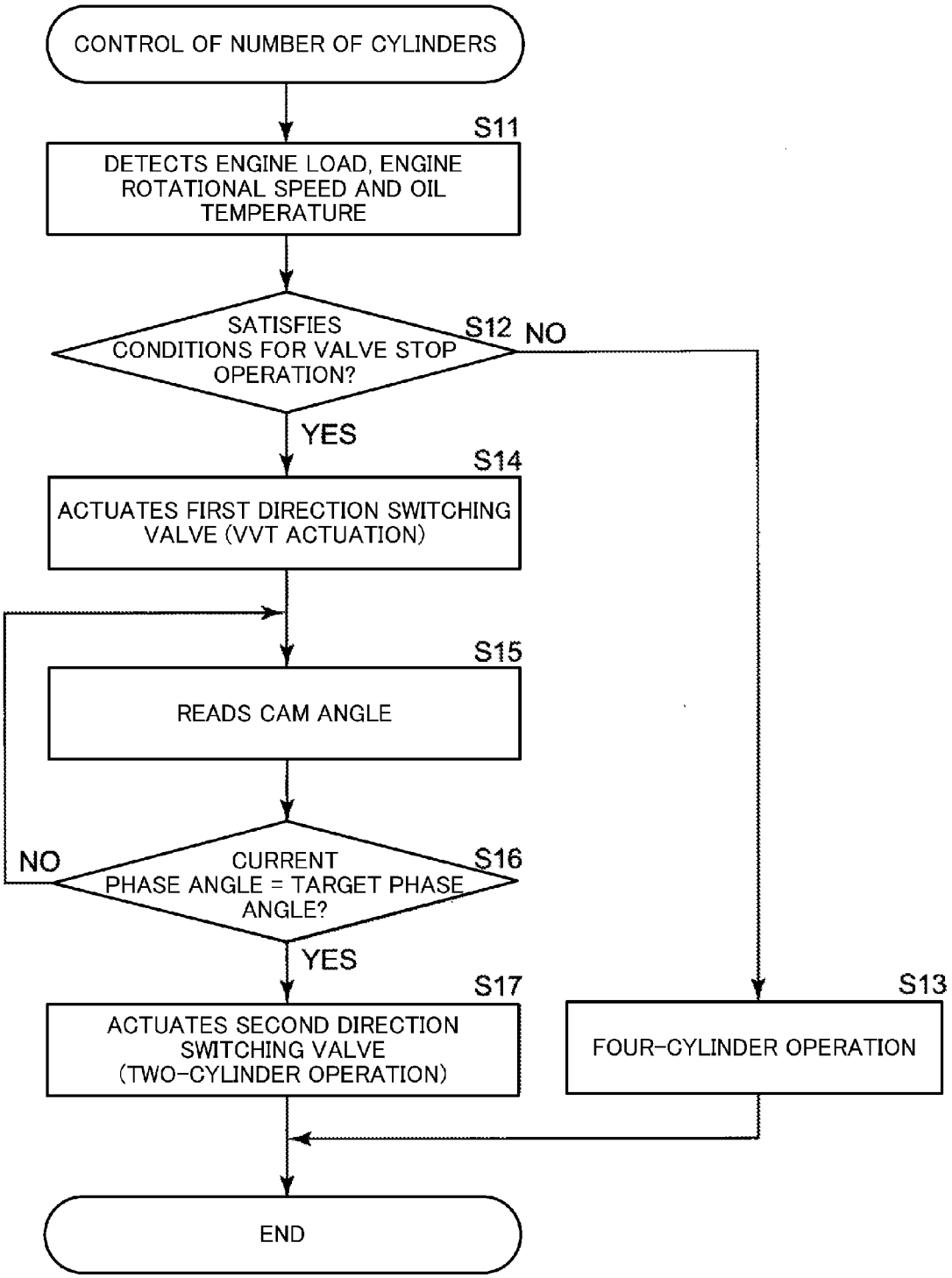
FIG. 15 is a flowchart showing control operation of a controller on the number of cylinders of the engine.

Now, the control operation of the number of cylinders by the controller 100 will be described with reference to the flowchart in FIG. 15.

First, in Step S11, the controller 100 read, from various sensors, information detected by the sensors, thereby detecting the engine load, the engine rotational speed, the water temperature, etc., to acquire the operational state of the engine 2.

Then, in the subsequent Step S12, the controller 100 determines whether the current operational state of the engine 2 satisfies conditions for valve stop operation or not (whether the current operational state of the engine 2 is in the reduced cylinder operation region or not), based on the engine load, the engine rotational speed and the water temperature which have been read.

If the determination in Step S12 is NO, the process goes to Step S13 in which four-cylinder operation (i.e., full cylinder operation) is carried out. In this operation, the same or similar operations as in Steps S14-S16, which will be described later, are carried out to operate the intake-side and exhaust-side first direction switching valves 34, 35 such that the current phase angles of the VVTs 32, 33 corresponding to the current cam angles read from the cam angle sensor 74 will be the same as target phase angles determined according to the operational state of the engine 2.

On the other hand, of the determination in Step S12 is YES, the process goes to Step S14 in which the intake-side and exhaust-side first direction switching valves 34, 35 are operated, and the current cam angles are read from the cam angle sensor 74 in the subsequent Step S15.

In the subsequent Step S16, the controller 100 determines whether the current phase angles of the VVTs 32, 33 corresponding to the current cam angles which have been read are the same as the target phase angles or not.

If the determination in Step S16 is NO, the process returns to Step S15. That is, the controller 100 prohibits the operation of the intake-side and exhaust-side second direction switching valves 46, 47 until the current phase angles will be the target phase angles.

If the determination in Step S16 is YES, the process goes to Step S17 in which the intake-side and exhaust-side second direction switching valves 46, 47 are operated to perform two-cylinder operation (i.e., reduced cylinder operation).

While the engine 2 is in steady operation at light loads (while the vehicle is in a steady driving mode), the locking pin 231 of the exhaust-side VVT 33 is brought into a locking state (i.e., the phase angle of the camshaft 19 is most advanced relative to the crankshaft 9) in the present embodiment.

When the engine rotational speed or the engine load increases from this state (i.e., when the engine accelerates), the VVT 33 is required to change the phase angle.

During this engine acceleration, the controller 100 controls the oil pump 36 such that the oil pressure detected by the hydraulic sensor 70 be the target oil pressure corresponding to the engine rotational speed or the engine load that is increasing. As a result, the oil discharge amount of the oil pump 36 increases.

Figure 16:
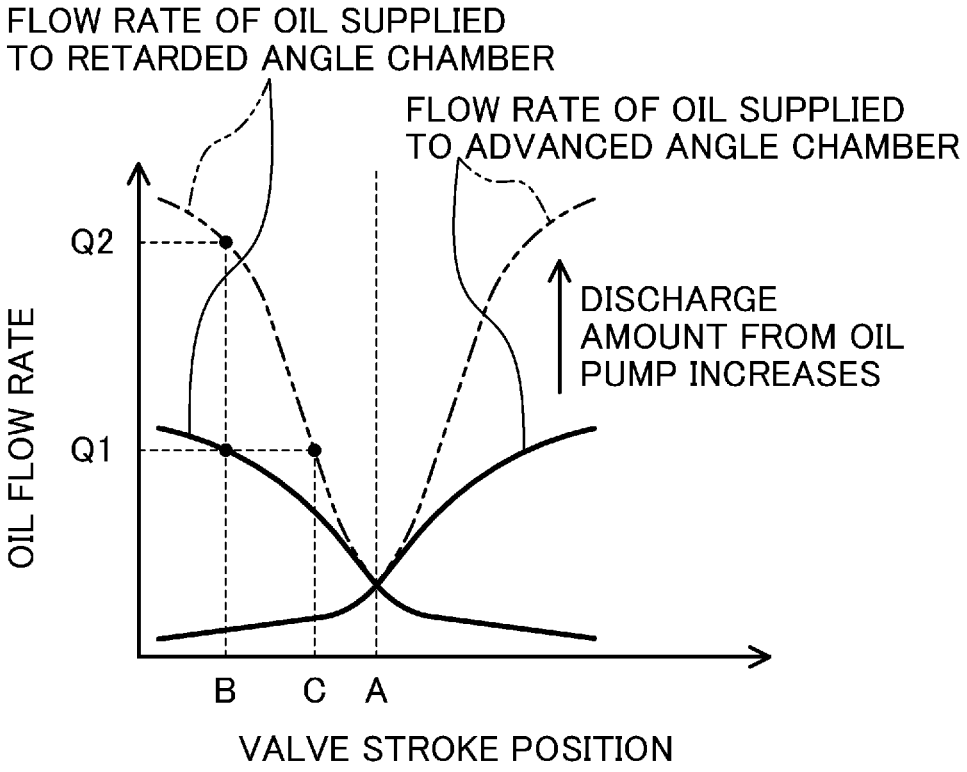
FIG. 16 is a graph showing a relationship between a valve stroke position of the exhaust-side first direction switching valve and a flow rate of oil supplied to the advanced angle chambers and the retarded angle chambers.

The flow rate of oil (i.e., the pressure of oil) supplied to the advanced angle chambers 207 and the retarded angle chambers 208 varies as shown in FIG. 16, depending on the valve stroke position of the exhaust-side first direction switching valve 35. The flow rate of the oil supplied to the advanced angle chambers 207 and the retarded angle chambers 208 varies depending on the oil discharge amount of the oil pump 36, as well. The greater the amount of oil discharged from the oil pump 36, the greater the flow rate of the oil supplied to the advanced angle chambers 207 and the retarded angle chambers 208 (see the two-dot chain line).

When the valve stroke position of the exhaust-side first direction switching valve 35 is at position A, the flow rate of the oil supplied to the advanced angle chambers 207 and the flow rate of the oil supplied to the retarded angle chambers 208 are the same. Thus, the phase angle of the camshaft 19 relative to the crankshaft 9 does not change. Further, at the position A, the locking pin 231 cannot be released from the locking state. If the valve stroke position is shifted, for example, to the left in FIG. 16, the flow rate of the oil supplied to the retarded angle chambers 208 increases, and the flow rate of the oil supplied to the advanced angle chambers 207 decreases (to a value close to zero (0)), compared with the case where the valve stroke position is at position A. That is, the flow rate of the oil supplied to the retarded angle chambers 208 is greater than the flow rate of the oil supplied to the advanced angle chambers 207, which moves the vane body toward the retarded angle side.

The valve stroke position of the exhaust-side first direction switching valve 35 is at the position A shown in FIG. 16 (where the flow rate of the oil supplied to the advanced angle chambers 207 and the flow rate of the oil supplied to the retarded angle chambers 208 are the same) while the locking pin 231 is in the locking state. The valve stroke position is shifted to the left in FIG. 16 from the position A so that the locking pin 231 is released from the locking state and that phase angle of the camshaft 19 relative to the crankshaft 9 is retarded. In this case, if the engine 2 is not accelerated, the valve stroke position is shifted to such a position at which, even when the oil pump 36 discharges a small amount of oil, the locking pin 231 can be released from the locking state with that small amount of oil discharged from the oil pump 36. In this example, the valve stroke position is shifted to the position B, where it is possible to obtain an oil flow rate Q1 which allows release of the locking pin 231 from the locking state.

However, the oil pump 36 discharges an increased amount of oil when it is required to change the phase angle at the acceleration of the engine as mentioned in the above description. Thus, just simply shifting the valve stroke position of the exhaust-side first direction switching valve 35 to the position B may increase the pressure supplied to the retarded angle chambers 208 too high during the release of the locking pin 231 from the locking state. As a result, the locking pin 231 may not be successfully released from the locking state.

Thus, while the oil pressure detected by the hydraulic sensor 70 increases, the controller 100 of the present embodiment adjusts the valve stroke position (i.e., a degree of opening) of the exhaust-side first direction switching valve 35 during the release of the locking pin 231 from the locking state, based on the oil pressure detected by the hydraulic sensor 70. Through the adjustment, the oil pressure supplied to the retarded angle chambers 208 to retard the phase angle of the camshaft 19 relative to the crankshaft 9 (i.e., the oil pressure for releasing the locking pin 231 from the locking state) is decreased, compared to when the valve stroke position (i.e., a degree of opening) is not adjusted. Specifically, if a greater oil pressure is detected (i.e., if the oil pump 36 discharges a greater amount of oil), the valve stroke position is shifted from the position B to position C at which the oil flow rate is the same as the oil flow rate Q1 that corresponds to the flow rate at the position B in a case where an oil discharge amount of the oil pump 36 is small. If the valve stroke position is maintained at the position B without adjustment, it results in a high flow rate (i.e., Q2) of the oil. This adjustment of the valve stroke position decreases the oil pressure supplied to the retarded angle chambers 208, compared with the case in which the valve stroke position is not adjusted (in other words, the oil flow rate drops from Q2, which is a value when the valve stroke position is not adjusted, to Q1). In the present embodiment, the dropped oil pressure needs to be higher than a lock release pressure due to the necessity of release of the locking pin 231 from the locking state. In order to lower the oil pressure as much as possible, it is recommended that the oil pressure be higher than, and close to, the lock release pressure.

Thus, even if the oil pressure detected increases due to the engine acceleration, the oil pressure supplied to the retarded angle chambers 208 is maintained at a low oil pressure by adjusting the degree of opening of the exhaust-side first direction switching valve 35 during the lock release operation. Even in such a low oil pressure, the oil pressure supplied to the advanced angle chambers 207 is lower than the oil pressure supplied to the retarded angle chamber 208 (see FIG. 16). Thus, although the camshaft 19 (the vane body 202) tends to turn in the retarded angle direction relative to the crankshaft 9 (the housing 201), the camshaft 19 (the vane body 202) cannot turn enough to completely finish releasing the locking pin 231 from the locking state. Despite that the camshaft 19 (the vane body 202) tends to turn in the retarded angle direction relative to the crankshaft 9 (the housing 201), it is possible to carry out stable release of the locking pin 231 from the locking state since a low oil pressure is supplied to the retarded angle chambers 208.

Note that when the valve stroke position is adjusted, it is recommended to correct the adjustment value according to the oil temperature detected by the oil temperature sensor 73. The oil viscosity changes depending on the oil temperature, and the flow rate of the oil supplied to the retarded angle chambers 208 changes depending on the oil viscosity. Thus, the oil pressure supplied to the retarded angle chambers 208 may be maintained at more appropriate oil pressure capable of carrying out stable release of the locking pin 231 from the locking state, by taking the oil viscosity into account.

Immediately after the completion of release of the locking pin 231 from the locking state, the camshaft 19 (the vane body 202) turns in the retarded angle direction relative to the crankshaft 9 (the housing 201), and shifts from the locked position. This may be detected through the detection of the phase angle of the VVT 33 by the cam angle sensor 74.

If the controller 100 detects the completion of the release of the locking pin 231 from the locking state (the shift of the camshaft 19 from the locked position), the valve stroke position of the exhaust-side first direction switching valve 35 is changed, for example, to a general valve stroke position (in this example, the position B in FIG. 16 at which the valve stroke position is not adjusted), and the valve-opening phase of the exhaust valve 15 is controlled. After the release of the locking pin 231 from the locking state, the greater the difference between the flow rate of the oil supplied to the advanced angle chambers 207 and the flow rate of the oil supplied to the retarded angle chambers 208 (the difference between the oil pressure supplied to the advanced angle chambers 207 and the oil pressure supplied to the retarded angle chambers 208) is, the faster the valve-opening phase of the exhaust valve 15 can be controlled.

Figure 17:
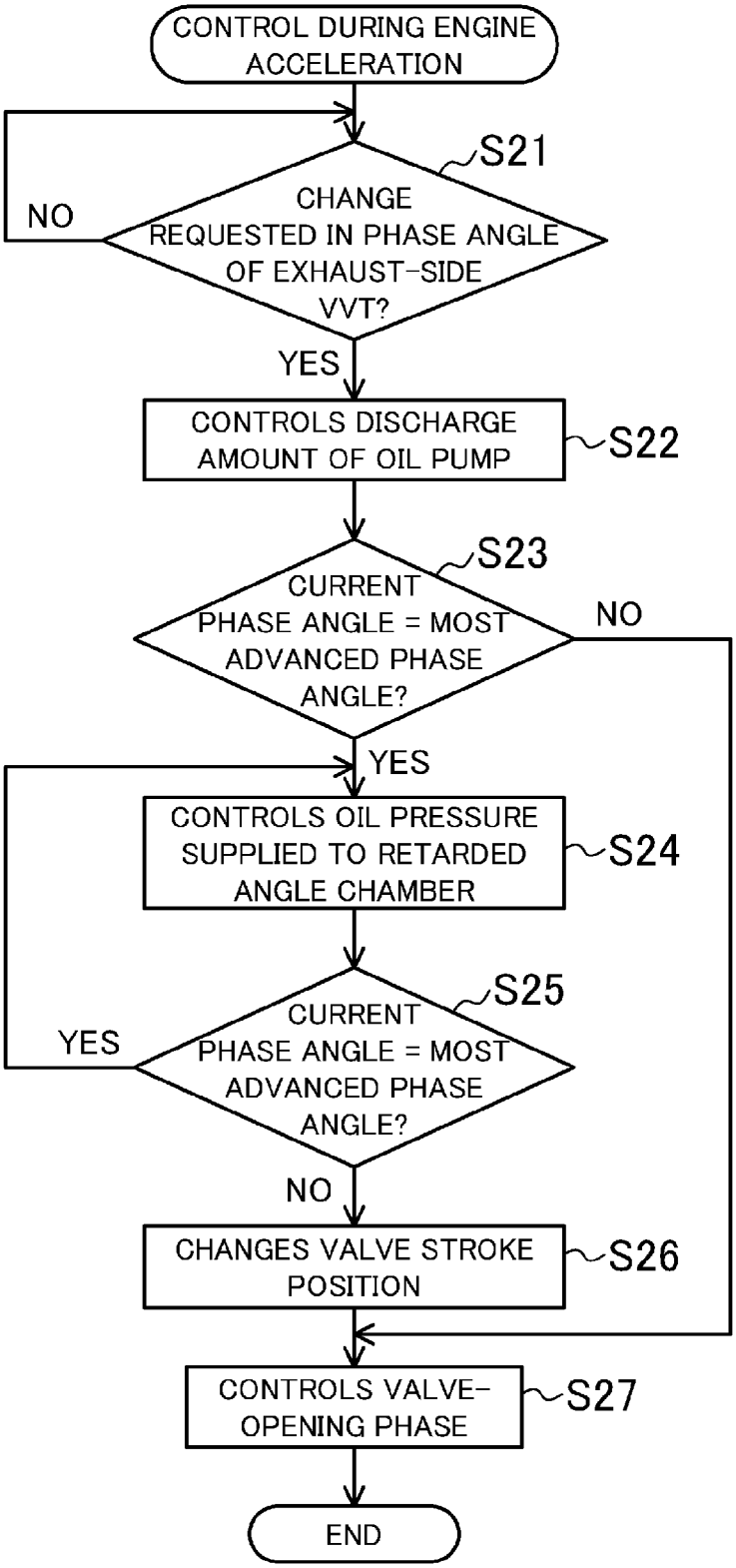
FIG. 17 is a flowchart showing control operation of a controller while the engine is accelerated.

The control operation by the controller 100 at the engine acceleration will be described with reference to the flowchart in FIG. 17.

In the first Step S21, the controller 100 determines whether or not the phase angle is required to be changed due to the engine acceleration. If the determination in Step S21 is NO, Step S21 is repeated. If the determination in Step S21 is YES, the process goes to Step S22.

In Step S22, the controller 100 controls the discharge amount of the oil pump 36 such that the oil pressure detected by the hydraulic sensor 70 be the target oil pressure corresponding to the engine rotational speed or the engine load that is increasing. When the engine 2 accelerates, the target oil pressure increases, and the oil pressure detected thus increases.

In the subsequent Step S23, the controller 100 reads the current cam angle from the cam angle sensor 74, and determines whether the current phase angle of the VVT 33 corresponding to the current cam angle which has been read is the most advanced phase angle or not, in other words, whether the locking pin 231 is in the locking state or not. The locking pin 231 is in the locking state when the engine 2 accelerates from the steady operational state at light loads. Thus, the determination in Step S23 is YES in general.

If the determination in Step S23 is NO, the process goes to Step S27. Specifically, the controller 100 immediately controls the valve-opening phase of the exhaust valve 15 if the locking pin 231 is not in the locking state. If the determination in Step S23 is YES, the process goes to Step S24, in which the valve stroke position of the exhaust-side first direction switching valve 35 is adjusted so that the oil pressure supplied to the retarded angle chambers 208 be adjusted to an oil pressure higher than, and close to, the lock release pressure.

In the subsequent Step S25, the controller 100 reads the current cam angle from the cam angle sensor 74 again, and determines whether the current phase angle of the VVT 33 corresponding to the current cam angle which has been read is the most advanced phase angle or not. If the determination in Step S25 is YES, the process returns to Step S24. If the determination in Step S25 is NO, the process goes to Step S26.

In Step S26, the valve stroke position of the exhaust-side first direction switching valve 35 is changed to the general valve stroke position. In subsequent Step S27, the controller 100 controls the exhaust-side first direction switching valve 35 according to the operational state of the engine 2, thereby controlling the valve-opening phase of the exhaust valve 15. The present control operation is finished thereafter.

In the present embodiment, the controller 100 serves as a pump controller which controls the discharge amount of the oil pump 36 such that the oil pressure detected by the hydraulic sensor 70 will be the target oil pressure determined according to the operational state of the engine 2, and also serves as a hydraulic control valve controller which controls the operation of the intake-side and exhaust-side first direction switching valves 34, 35.

In the present embodiment, while the oil pressure detected by the hydraulic sensor 70 increases, the controller 100 adjusts the valve stroke position (i.e., a degree of opening) of the exhaust-side first direction switching valve 35 during the release of the locking pin 231 of the VVT 33 from the locking state, based on the oil pressure detected by the hydraulic sensor 70. Through this adjustment, the flow rate of the oil supplied to the retarded angle chambers 208 to change the phase angle of the camshaft 19 relative to the crankshaft 9 is decreased, compared to when the valve stroke position is not adjusted, thereby reducing an increase in the oil pressure and reducing the oil pressure to be supplied to the retarded angle chambers 208. This allows the locking pin 231 to be reliably released from the locking state while the engine is accelerated, and allows immediate control of the valve-opening phase of the exhaust valve 15.

The present invention is not limited to the above embodiment, and is capable of substitutions without deviating from the subject matters of the claims.

For example, in the above embodiment, the present invention has been applied to releasing the locking state of the exhaust-side VVT 33. However, if the locking pin 231 of the intake-side VVT 32 is brought into the locking state while the engine 2 is in steady operation at light loads, and the VVT 32 is required to change the phase angle while the engine 2 is accelerated, then the present invention may also be applied to releasing the locking state of the intake-side VVT 32. Specifically, while the oil pressure detected by the hydraulic sensor 70 increases, the controller 100 adjusts the valve stroke position (i.e., a degree of opening) of the intake-side first direction switching valve 34 during the release of the locking pin 231 of the VVT 32 from the locking state according to the detected oil pressure. Through this adjustment, the oil pressure supplied to the advanced angle chambers 207 to change the phase angle of the camshaft 18 relative to the crankshaft 9 is decreased, compared to when the valve stroke position is not adjusted. Alternatively, the present invention may be applied to both of the VVTs 32, 33.

Further, in the above embodiment, the hydraulic path extending from the exhaust-side first direction switching valve 35 to the locking mechanism 230 of the exhaust-side VVT 33 is commonly used as the hydraulic path (the retarded angle side oil passage 212) extending from the exhaust-side first direction switching valve 35 to the retarded angle chambers 208. Thus, the locking state of the locking pin 231 of the exhaust-side VVT 33 is released by the oil pressure supplied to the retarded angle chambers 208. However, the hydraulic path extending from the exhaust-side first direction switching valve 35 to the locking mechanism 230 of the exhaust-side VVT 33 may be provided independently of the retarded angle side oil passage 212. The oil pressure is supplied to the locking mechanism 230 from the exhaust-side first direction switching valve 35, via the independently-provided hydraulic path, thereby releasing the locking pin 231 of the VVT 33 from the locking state. In this case, the exhaust-side first direction switching valve 35 is such a valve that is capable of controlling the respective oil pressures supplied to the locking mechanism 230 of the VVT 33, the advanced angle chambers 207, and the retarded angle chambers 208. Further, instead of using the oil pressure supplied to the advanced angle chambers 207 to release the locking pin 231 of the intake-side VVT 32 from the locking state, the locking pin 231 of the VVT 32 may be released from the locking state by the oil pressure supplied from the intake-side first direction switching valve 34 to the locking mechanism 230 via a different hydraulic path than the advanced angle side oil passage 211. In this case, the intake-side first direction switching valve 34 is such a valve that is capable of controlling the respective oil pressures supplied to the locking mechanism 230 of the VVT 32, the advanced angle chambers 207, and the retarded angle chambers 208.

In the above embodiment, a variable displacement oil pump (a variable oil pump) capable of controlling a discharge amount of oil is used as an oil pump for supplying oil to a hydraulically-actuated device via a hydraulic path. However, the oil pump is not limited to the variable displacement oil pump, and may be a commonly-used oil pump whose discharge amount can only be changed through engine rotational speed. The oil pump may also be an electric oil pump (a variable oil pump) which discharges a predetermined volume by motor actuation, and whose oil discharge amount is controlled by controlling the number of rotations of the motor.

The foregoing embodiment is a merely preferred example in nature, and the scope of the present invention should not be interpreted in a limited manner. The scope of the present invention is defined by the appended claims, and all variations and modifications belonging to a range equivalent to the range of the claims are within the scope of the present invention.

INDUSTRIAL APPLICABILITY

The present invention is useful as a valve timing control device for an engine which controls the opening/closing timing of the intake and exhaust valves of the engine, according to an operational state of the engine, using a hydraulically-actuated variable valve timing mechanism.

DESCRIPTION OF REFERENCE CHARACTERS

2 Engine
9 Crankshaft
14 Intake Valve
15 Exhaust Valve
18 Intake-Side Camshaft
19 Exhaust-Side Camshaft
32 Intake-Side Variable Valve Timing Mechanism (Hydraulically-Actuated Device)
33 Exhaust-Side variable Valve Timing Mechanism (Hydraulically-Actuated Device)
34 Intake-Side First Direction Switching Valve (Hydraulic Control Valve)
35 Exhaust-Side First Direction Switching Valve (Hydraulic Control Valve)
36 Variable Displacement Oil Pump (Variable Oil Pump)
70 Hydraulic Sensor
73 Oil Temperature Sensor
100 Controller (Hydraulic Control Valve Controller) (Pump Controller)
230 Locking Mechanism
231 Locking Pin (Locking Member)

The invention claimed is:

1. A valve timing control device for an engine, comprising:

a hydraulically-actuated variable valve timing mechanism provided with an advanced angle chamber and a retarded angle chamber defined by a housing, which rotates in conjunction with a crankshaft of the engine, and a vane body, which rotates integrally with a camshaft, each of the advanced angle chamber and the retarded angle chamber being used to change a phase angle of the camshaft relative to the crankshaft by being supplied with an oil pressure, and a locking mechanism which includes a locking member configured to fix the phase angle of the camshaft relative to the crankshaft, and releases the locking member from a locking state through supply of an oil pressure;

an oil pump which supplies oil to a hydraulically-actuated device of the engine via a hydraulic path, the hydraulically-actuated device including the variable valve timing mechanism;

a hydraulic control valve which controls the oil pressures supplied to the locking mechanism, the advanced angle chamber and the retarded angle chamber;

a hydraulic sensor which detects an oil pressure in the hydraulic path; and a hydraulic control valve controller which control operation of the hydraulic control valve, wherein the hydraulic control valve controller is configured to increase an oil pressure to be supplied to the retarded angle chamber to retard the phase angle, and increase an oil pressure to be supplied to the advanced angle chamber to advance the phase angle, and while the oil pressure detected by the hydraulic sensor increases, the hydraulic control valve controller adjusts a degree of opening of the hydraulic control valve according to the detected oil pressure at a time of releasing the locking member of the locking mechanism from the locking state, to reduce an increment of the oil pressure to be supplied to the advanced angle chamber or the retarded angle chamber used to change the phase angle of the camshaft relative to the crankshaft.

2. The device of claim 1, further comprising:

an oil temperature sensor which detects an oil temperature in the hydraulic path, wherein the hydraulic control valve controller is configured to correct an adjustment value of the degree of opening of the hydraulic control valve according to the oil temperature detected by the oil temperature sensor.

3. The device of claim 1, wherein the oil pump is a variable oil pump whose oil discharge amount is controllable, and the valve timing control device for the engine further comprises a pump controller which controls the oil discharge amount of the oil pump such that the oil pressure detected by the hydraulic sensor be a target oil pressure determined according to an operational state of the engine.

4. The device of claim 2, wherein the oil pump is a variable oil pump whose oil discharge amount is controllable, and the valve timing control device for the engine further comprises a pump controller which controls the oil discharge amount of the oil pump such that the oil pressure detected by the hydraulic sensor be a target oil pressure determined according to an operational state of the engine.

* * * * *